US008326165B2

(12) United States Patent
Kubo et al.

(10) Patent No.: US 8,326,165 B2
(45) Date of Patent: Dec. 4, 2012

(54) IMAGE FORMING APPARATUS HAVING A PHOTOSENSTIVE MEMBER OF HIGH CAPACITANCE

(75) Inventors: Kenta Kubo, Shizuoka-ken (JP); Manami Haraguchi, Yokohama (JP); Takeshi Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1024 days.

(21) Appl. No.: 11/532,742

(22) Filed: Sep. 18, 2006

(65) Prior Publication Data

US 2007/0071472 A1 Mar. 29, 2007

(30) Foreign Application Priority Data

Sep. 21, 2005 (JP) ..... 2005-274049
Sep. 12, 2006 (JP) ..... 2006-246631

(51) Int. Cl.
*G03G 15/043* (2006.01)

(52) U.S. Cl. ..... 399/51; 399/55; 399/159

(58) Field of Classification Search ..... 399/51, 399/55, 159
See application file for complete search history.

(56) References Cited

U.S. PATENT DOCUMENTS 5,701,551 A 12/1997 Honda et al.
5,835,819 A 11/1998 Yamamoto
6,324,365 B1 * 11/2001 Morikawa et al. ..... 399/159
6,337,966 B1 1/2002 Yamamoto
6,564,027 B2 5/2003 Haraguchi et al.
6,694,110 B2 2/2004 Akashi et al.
2002/0027591 A1 * 3/2002 Itoh ..... 399/51
2002/0090561 A1 * 7/2002 Nagasaka et al.
2005/0089340 A1 4/2005 Yamamoto
2007/0071473 A1 3/2007 Haraguchi et al.

FOREIGN PATENT DOCUMENTS

JP 11-196277 A 7/1999
JP 11-338170 12/1999
JP 2002-149034 A 5/2002
JP 2003-89238 A 3/2003
JP 2004-279902 10/2004

OTHER PUBLICATIONS

Notification of Reason for Refusal dated Mar. 22, 2011, in counterpart Japanese Application No. 2006-246631.

* cited by examiner

*Primary Examiner* — David Gray
*Assistant Examiner* — Laura Roth
(74) *Attorney, Agent, or Firm* — Fitzpatrick, Cella, Harper & Scinto

(57) ABSTRACT

An image forming apparatus includes a photosensitive member, having a capacitance per unit area of $1.7\times10^{-6}$ (F/m$^2$) or larger, an exposure device, which exposes the photosensitive member in order to form thereon an electrostatic image according to image information, a developing device, which develops the electrostatic image with a toner to form a toner image on the photosensitive member, and a transfer device, which transfers the toner image onto a recording material. In forming a solid toner image on the recording material, the exposure device is capable of forming electrostatic images of different potential levels on the photosensitive member, thereby forming toner images of different toner heights on the photosensitive member.

4 Claims, 12 Drawing Sheets

1LINE 1SPACE (EMBODIMENT 1)

1LINE 1SPACE + 25% (EMBODIMENT 2)

IMAGE FORMING APPARATUS HAVING A PHOTOSENSTIVE MEMBER OF HIGH CAPACITANCE

BACKGROUND OF THE INVENTION

1. Field of the Invention

The present invention relates to an image forming apparatus of electrophotographic process, such as a copying machine or a printer.

It particularly relates to an image forming apparatus utilizing a photosensitive member of a high capacitance having a capacitance (C/S) per unit area satisfying a relation $C/S \geqq 1.7\times10^{-6}$ ($F/m^2$)

2. Description of the Related Art

In the image forming apparatus of electrophotographic process, a higher image quality, a higher output speed and a higher stability for the output image are being requested along with the advancement toward the full-color configuration and the digital structure, and an entry into the printing market is expected. However, in order that the copying machine and the like can enter the printing market, an image quality, an output speed and a stability even higher than the current level are essential issues to be solved.

An image bearing member currently employed in the electrophotographic process (electrostatic process) includes a selenium-based photoreceptor, an amorphous silicon photoreceptor, and an organic photoreceptor (OPC).

Among these, the amorphous silicon photoreceptor, being provided with a charge generation layer in the proximity of a surface layer as shown in FIG. 1 schematically illustrating a layered structure, can suppress the diffusion of a charge generated at an exposure. It is therefore capable of realizing a high image quality, excellent in dot reproducibility, and is excellent in durability because of a very high hardness, thus being anticipated for an image bearing member capable of realizing a high speed and a high stability (for example cf. Japanese Patent Application Laid-open No. 2004-279902).

In an image forming apparatus for forming an electrostatic latent image by a digital exposure, which exposes an image in accordance with an image signal, the latent image forming method for tone reproduction can be generally classified into following two methods.

A first method is an image processing method such as a dither method or a density pattern method, classified as a binary recording method. In the dither method, as shown in FIG. 2A, one pixel in the read input signal is made to correspond to one pixel of binary recording. In the density pattern method, as shown in FIG. 2C, one pixel in the read input signal is made to correspond to plural recording pixels. In an intermediate method of these two methods, as shown in FIG. 2B, one pixel in the read input signal is made to correspond to a partial matrix (1×1) within an m×m matrix. In such correspondence to the partial matrix, a case of 1=1 corresponds to the dither method while a case of 1=m corresponds to the density pattern method, and an arbitrary value may be adopted for varying the output image size. Also these image processing methods are classified into a screen pattern method utilizing a screen structure, and an error diffusion method not utilizing a screen structure.

A second method is a multilevel recording method, utilizing a pulse width modulation or an intensity modulation. In such method, an irradiation time or an intensity of a laser beam is modulated according to the image signal, thereby executing an area coverage modulation of a dot formed by a beam spot for each pixel. In this manner, a tone reproduction is made possible without deteriorating the resolution. It is also possible to secure the number of tone levels by combining such dither method and the pulse width modulation.

Now, there will be explained, in an image forming apparatus utilizing an image exposure with a laser scanning exposure means as the digital exposure means, a method of reproducing a medium tone portion (medium tone image portion) to a solid portion (solid image portion) by a pulse width modulation. The surface of the image bearing member (photosensitive member) is charged to a predetermined dark potential by a charger, and is subjected to an image exposure by a scanning with a laser beam. In an exposed portion of the image bearing member, the potential is decayed from a dark potential to a light potential thereby forming an electrostatic latent image on the image bearing member. Such electrostatic latent image is developed as a toner image by a reversal developing device.

In a solid image portion, the laser continues to be turned on, as illustrated in (1-3) in FIG. 3, at the latent image formation by a laser scanning exposure, and a flat latent image as shown in (2-3) is formed into a flat toner image as shown in (3-3).

On the other hand, for a medium tone, the laser oscillation time in the solid image portion is divided into 256 oscillation times (00h-FFh) in order to obtain 256 tone levels (cf. (1-1) and (1-2)). A latent image in such state involves irregularities as shown in (2-1) and (2-2), and is developed as a toner image as shown in (3-1) and (3-2).

In this manner, 256 tone levels from the solid image portion to the medium portion are reproduced.

A developing device, for developing an electrostatic latent image with a toner, is classified into two types. The first is a two-component developing device, which executes the development with a two-component developer formed by a magnetic carrier and a non-magnetic toner. The second is a one-component developing device, which executes the development utilizing toner (magnetic or non-magnetic) only as the developer.

The two-component developing device is provided with a developer carrying member, generally including therein a magnet roller formed by a magnetic member having plural magnetic poles. The two-component developer, formed by mixing and charging toner and carrier, is borne on the developing carrying member by a magnetic force, and is carried to a development area provided between the developer carrying member and the image bearing member opposed thereto. A development bias is applied to the developer carrying member to generate a developing electric field in the developing area, thereby separating the toner, sticking to the carrier, from the carrier and executing the development of the electrostatic latent image on the image bearing member. It is known that the developing method by the two-component development can provide a stable charge on the toner, because the charging is executed by mixing/agitation of the toner and the carrier, thereby providing a stable satisfactory image.

On the other hand, in the one-component developing device, a developer carrying member, carrying the toner, is contacted with the image bearing member or is opposed in a non-contact state thereto and in a proximity thereof, and a development bias is applied to the developer carrying member, whereby the electrostatic latent image on the image bearing member is developed with the toner.

However, the amorphous silicon photoreceptor (hereinafter represented as α-Si photoreceptor) involves a drawback of causing an image defect, called "blank area". Such "blank area" will be explained in the following. The blank area means, when a medium tone portion in a leading part and a solid image portion in a trailing part, in the traveling direction of the image bearing surface, are developed as shown in FIG.

4, a phenomenon that the developed density decreases in a boundary portion between the medium tone portion and the solid image portion.

A generating mechanism for such blank area is as follows. FIG. 5 shows latent image potentials in the medium tone portion and the solid image portion. When the development bias is applied to the developer carrying member, with respect to a latent image potential (light potential) Vl of the solid image portion, a difference between a DC component Vdc of the development bias and the light potential Vl constitutes a development contrast Vcont. The development in the solid image portion is executed in such a manner that a potential, generated by the development of the latent image in the solid image portion with the toner (such potential being hereinafter called a charge potential ΔV) fills in the development contrast Vcont. Such charge potential means, with respect to the light potential, a surface potential of the toner layer after the development of the latent image in the solid image portion.

However, when there is generated a "deficient charging" in which the development is terminated in a state where the charge potential ΔV of the solid image portion cannot sufficiently fill in the development contrast Vcont as shown in FIG. 6, a potential difference is generated between the medium tone portion and the solid image portion. Such potential difference generates a "wraparound electric field" directed from the medium tone portion toward the solid image portion. Therefore, the electric field between the developer carrying member in the developing device and the image bearing member includes not only the electric field in a direction from the developer carrying member toward the image bearing member but also a wraparound electric field generated in the boundary area between the medium tone portion and the solid image portion. In the boundary area between the medium tone portion and the solid portion, the toner is not deposited on the medium tone portion but on the solid portion by such wraparound electric field, thus generating a "blank area".

As explained above, the blank area is generated in case of a large potential difference between the medium tone portion and the solid portion, by a deficient charging in the solid portion. Therefore, even in a case, opposite to the situation shown in FIG. 4, where a solid portion in a leading part and a medium tone portion in a trailing part, in the traveling direction of the image bearing surface, are developed, the blank area is generated by the potential difference between the solid portion and the medium tone portion when the solid portion shows a deficient charging. However, in the case that a medium tone portion is developed in the leading end as shown in FIG. 4, the potential difference becomes larger because the medium tone portion is developed while the solid portion is not yet developed with the toner, whereby the blank area appears conspicuously. On the other hand, in the case that a solid portion is developed in the leading end, the development of the medium tone portion starts after the development of the solid portion; whereby the potential difference becomes smaller and the blank area becomes less conspicuous.

A charge potential, generated by the development of a latent image with the toner, is theoretically represented by an equation 1.

$$\Delta Vth = \Delta Vt + \Delta Vc = \frac{dt}{2\varepsilon_0\varepsilon_t}\left\langle\frac{Q}{S}\right\rangle + \frac{dm}{\varepsilon_0\varepsilon_m}\left\langle\frac{Q}{S}\right\rangle \quad \text{Equation 1}$$

wherein:

dt: height of toner layer on image bearing member dm: film thickness of image bearing member (total film thickness excluding a base)

Q/S: toner charge amount per unit area on image bearing member $\epsilon_0$: vacuum permittivity $\epsilon_t$: permittivity of toner layer $\epsilon_m$: relative permittivity of image bearing member.

These items are substituted naturally with such units as to satisfy the dimension of the equation. In the equation 1, a first term is a potential ΔVt generated by the toner layer itself in the proximity thereof, and a second term is a potential ΔVc generated by a capacitor effect between the toner layer and the base layer of the image bearing member. A sum of both terms constitutes a potential generated at the development of the latent image with the toner, namely the charge potential ΔVth. ΔV is a measured value of the charge potential, and ΔVth is a theoretical value of the charge potential (derived form the equation 1). Also the film thickness dm of the image bearing member indicates a thickness of an actual photoconductive layer i.e. a layer thickness excluding a base 5 in the image bearing member. More specifically, in case of an α-Si photoreceptor constituted of a surface layer 1, an electron blocking layer 2, a charge generation layer 3, a hole blocking layer 4 and a base 5 as shown in FIG. 1, the film thickness dm of the photoconductive layer is a sum of the thicknesses of the surface layer 1, the electron blocking layer 2, the charge generation layer 3, and the hole blocking layer 4 excluding the thicknesses of the base 5. On the other hand, for an organic photoreceptor, the film thickness dm of the photoconductive layer is a sum of a surface layer, a charge generation layer, and a charge transport layer when there is the surface layer, and a sum of a charge generation layer and a charge transport layer when there is no surface layer. In a case where an undercoat layer is provided on the base, the thickness dm of the photoconductive layer does not include the thickness of the undercoat layer.

As the α-Si photoreceptor has a permittivity $\epsilon_m$ of about 3 times in comparison with the organic photoreceptor, the capacitance C/S ($=\epsilon_0\times\epsilon_m/dm$) per unit area for a same film thickness becomes about 3 times larger. Also for improving the dot reproducibility, it is preferable to reduce the film thickness dm of the image bearing member, thus suppressing the charge diffusion. It is found preferable to maintain the film thickness dm at 50 μm or less in the α-Si photoreceptor for realizing an acceptable dot reproducibility, and, in the organic photoreceptor, to maintain the film thickness at 17 μm or less for realizing a dot reproducibility comparable to that in the case of α-Si photoreceptor. In such case, the capacitance C/S per unit area was $1.7\times10^{-6}$ ($F/m^2$) for each image bearing member.

When the image bearing member is given a high capacitance in order to improve the dot reproducibility, even when the latent image is developed with a toner of a same Q/S (toner charge amount per unit area), the second term decreases because of the larger capacitance of the image bearing member.

Stated differently, in an image bearing member of a high capacitance such as an α-Si photoreceptor, more specifically in an image bearing member having a high capacitance per unit area (C/S) satisfying a condition $C/S \geqq 1.7\times10^{-6}$ ($F/m^2$), the charge potential ΔV decreases in comparison with an image bearing member of a low capacitance such as an organic photoreceptor. It is therefore liable to cause a "deficient charging" in which the charge potential cannot fully fill in the development contrast Vcont.

Thus, in order to improve the image quality (dot reproducibility), it is necessary to suppress the diffusion of the charge generated in the charge generation layer of the image bearing member at the exposure. The α-Si photoreceptor, in which the charge generation layer may be formed close to the surface layer as shown in FIG. 1, can suppress the charge diffusion, thus it is advantageous in providing an excellent dot reproducibility. On the other hand, in the organic photoreceptor, in which the charge generation layer is distanced from the surface layer, the level of diffusion is aggravated according to the distance. It is therefore inferior in the dot reproducibility. It is found that an acceptable dot reproducibility can be realized, in a case of an α-Si photoreceptor, for a film thickness dm of 50 μm or less, and, in a case of an organic photoreceptor, for a film thickness dm of 17 μm or less. In such state, $C/S\ (=\epsilon_0\epsilon_m/dm)=1.7\times10^{-6}\ (F/m^2)$ is selected as a lower limit. Based on these technical reasons, the aforementioned condition $C/S \geqq 1.7\times10^{-6}\ (F/m^2)$ is selected.

The capacitance is determined by the permittivity and the film thickness of the image bearing member, and varies significantly depending on the product. As the α-Si photoreceptor has a permittivity of ÷10 while the organic photoreceptor has a permittivity of ÷3, the capacitance in the α-Si photoreceptor is about 3 times that of the organic photoreceptor for a same film thickness.

Now a method of measuring the capacitance (C/S) of the image bearing member, employed in the present investigation, will be explained. A flat-shaped photosensitive plate is prepared by forming a layered structured same as the actual photoconductive layer (charge generation layer, charge transport layer and surface layer) on a metal base, and an electrode, smaller than the photosensitive member, is contacted. A current, generated when a DC voltage is applied to the electrode, is monitored and an obtained current curve is integrated in time to determine a charge amount q accumulated in the photoconductive layer. This measurement was repeated for different DC voltages, and a capacitance (C) of the photosensitive plate is determined from a gradient between the charge amount q and the voltage V. Then a capacitance per unit area (C/S) was determined based on an area (S) of the used electrode. Also a method of measuring the film thickness (dm) and relative permittivity $\epsilon_m$ of the image bearing member, employed in the present investigation, will be explained. Thickness of the aforementioned photosensitive plate was measured with a film thickness meter before and after providing the photoconductive layer, and the film thickness dm of the photoconductive layer was determined from the difference in the thickness. Also the relative permittivity ϵm was determined by substituting the capacitance (C/S) and the film thickness (dm), determined as explained above, into a theoretical equation ($\epsilon_m=(C\cdot dm)/(S\cdot\epsilon_0)$).

As explained above, an image bearing member of a high capacitance, such as an α-Si photoreceptor, involves a drawback of causing a blank area image defect by the deficient charging described above.

Now there will be explained a drawback in tone reproducibility caused by such deficient charging. In a prior organic photoreceptor of a low capacitance, a charging of filling in the development contrast Vcont with the charge potential ΔV is completed within the developing area, whereby the development of the latent image is completed properly. On the other hand, in an image bearing member of a high capacitance, the development of the latent image cannot be completed properly because of a deficient charging, whereby the developed toner amount increases. For this reason, the development contrast Vcont, required for obtaining the necessary image density, becomes decreased and the V-D curve (showing image density as a function of development contrast at arbitrary 16 tone levels within 256 tone levels) tends to become steeper as shown in FIG. 22, whereby the tone reproducibility becomes difficult to realize.

A shift to a higher capacitance in the image bearing member is unavoidable in the trend hereafter toward a higher image quality and a higher stability. In order to utilize an image bearing member of a high capacitance such as an α-Si photoreceptor, it is essential to solve the image defect described above, namely a deficient charging in the image bearing member of high capacitance.

SUMMARY OF THE INVENTION

An object of the present invention is to provide an image forming apparatus, capable of suppressing an image defect in case of utilizing a photosensitive member of a high capacitance.

Another object of the present invention is to provide an image forming apparatus capable of reducing an image blank area generated in a boundary portion between images of mutually different image densities.

Still another object of the present invention is to provide an mage image forming apparatus capable of suppressing, in a development, a deficient charging on the latent image potential by the toner.

Still another object of the present invention is to provide an mage image forming apparatus excellent in tone reproducibility.

Further features of the present invention will become apparent from the following description of exemplary embodiments with reference to the attached drawings.

DESCRIPTION OF THE EMBODIMENTS

(1) Example of Image Forming Apparatus

Figure 8:
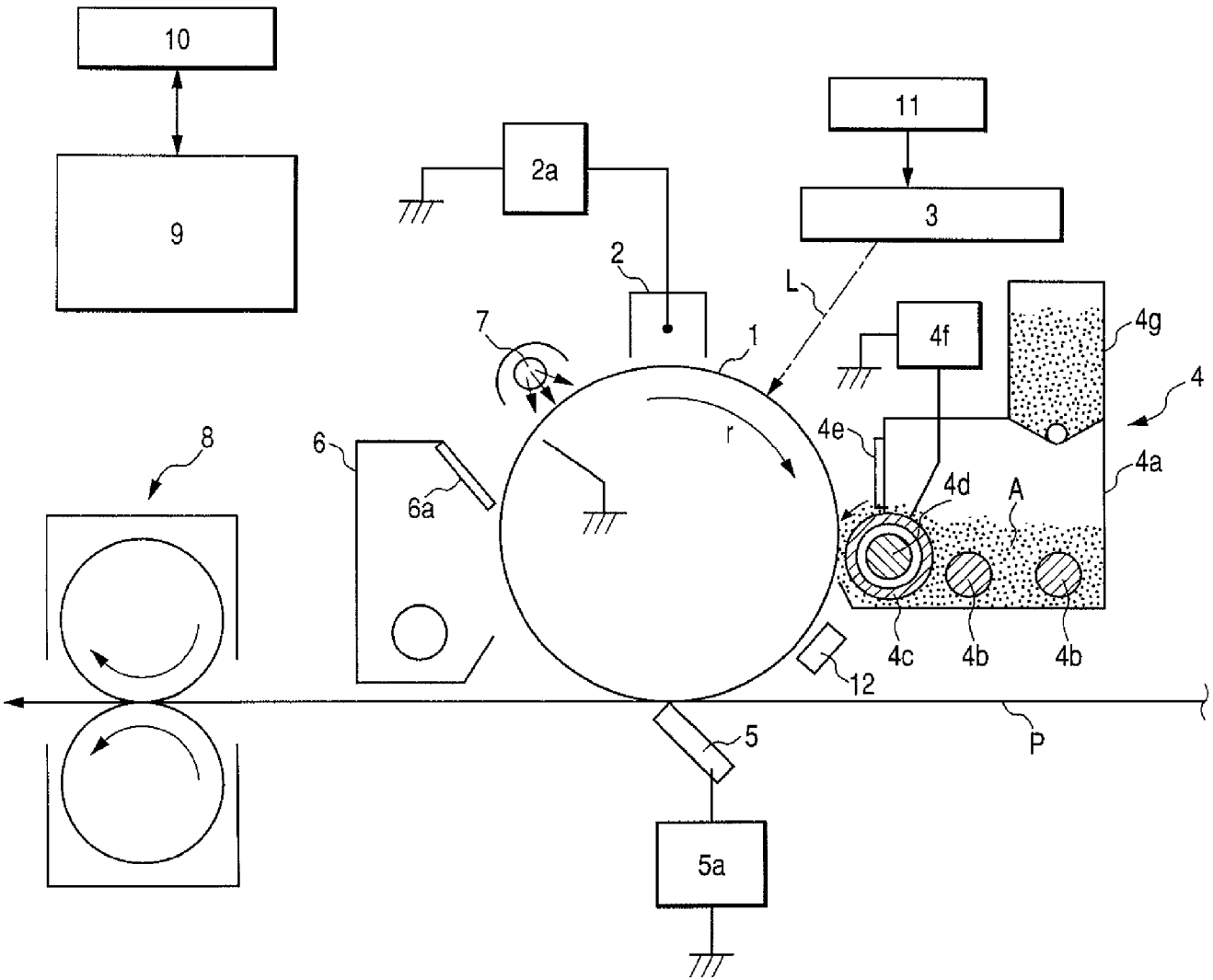
FIG. 8 is a schematic view showing a constitution of an embodiment of the image forming apparatus.

FIG. 8 is a schematic view showing a structure of an image forming apparatus. This image forming apparatus is a laser beam printer, utilizing an electrophotographic process, a digital image exposure method, a reversal development process and a transfer process.

A reference numeral 1 indicates a drum-shaped electrophotographic photosensitive member, constituting an image bearing member. The image bearing member is of a high capacitance type, having a capacitance per unit area (C/S) of $C/S \geqq 1.7\times10^{-6}$ ($F/m^2$). As described above, the image bearing member of such high capacitance has an advantage of being superior in dot reproducibility. On the other hand, it involves, as described above, a drawback of generating an image defect called a blank area, by a deficient charging. It also involves a drawback that the tone reproducibility is difficult to attain. In contrast, a photosensitive member of $C/S<1.7\times10^{-6}$ ($F/M^2$) does not have such drawbacks.

Figure 1:
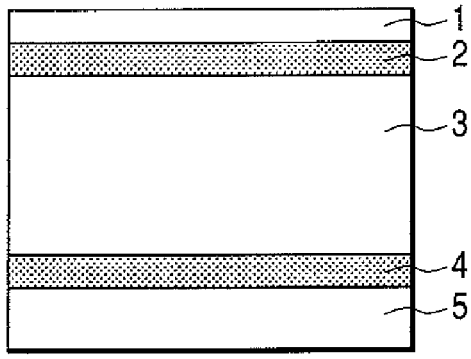
FIG. 1 is a schematic view showing a layered structure of an α-Si photoreceptor.
Figure 2A:
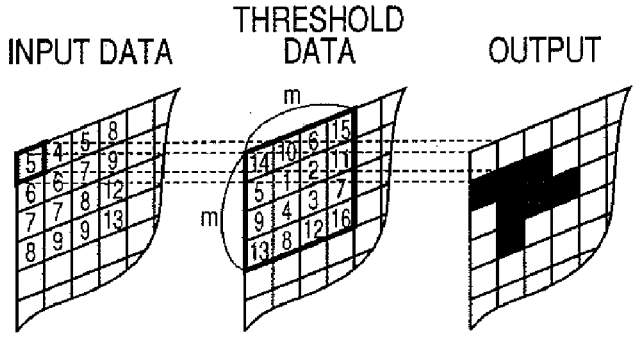
FIGS. 2A, 2B and 2C are views showing image forming methods.
Figure 2B:
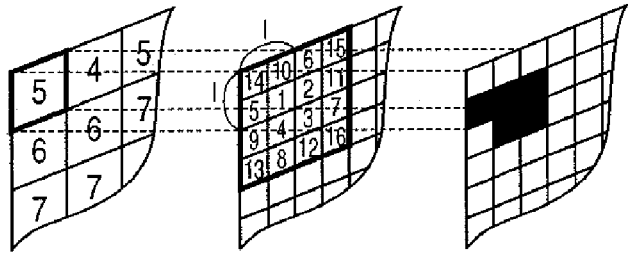
Figure 2C:
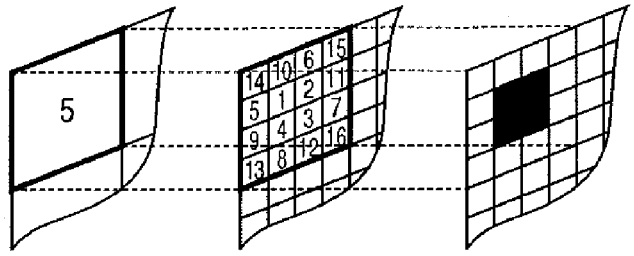

In the present embodiment, the image bearing member 1 is constituted of an amorphous silicon photoreceptor (α-Si photoreceptor). The α-Si photoreceptor is basically constructed by forming an α-Si photoconductive layer on a conductive base. The α-Si photoconductive layer is formed from an amorphous silicon material such as Si, SiC, SiO or SiON, for example by a glow discharge method, a sputtering method, an ECR method or an evaporation method. The α-Si photoreceptor has a layer structure as shown in FIG. 1.

The image bearing member 1 is rotated clockwise, as indicated by an arrow "r", with a predetermined speed, and a surface thereof is uniformly charged by a primary charger 2 at a predetermined dark potential Vd. A reference numeral 2*a* indicates a charging bias applying source for the primary charger 2.

A laser scanner (laser exposure device) 3 serving as digital exposure means receives a time-series electrical digital pixel signal from a host apparatus 11 such as an image scanner. In the host apparatus 11, an image signal obtained for example by a CCD is digitized by an A/D converter, and is supplied to a signal processing part for conversion into a binary image signal corresponding to the image density. Such image signal is supplied to the scanner 3. The scanner 3 includes a laser driver, a laser, a polygon mirror, a mirror etc., in which the laser driver receives the image signal. The laser driver modulates the light emission of the laser, according to the input image signal. The surface of the image bearing member 1, having the dark potential, is subjected to a scan exposure L (image exposure) by the modulated laser beam. In an exposed portion, the dark potential is decayed to a light potential Vl, thereby forming an electrostatic latent image. The image exposure method means a process in which a portion of the photosensitive member, where the toner is to be deposited at the development, is exposed in advance and in which a light potential portion on the photosensitive member is developed with the toner.

A developing device 4 develops the electrostatic latent image, formed on the surface of the image bearing member 1, as a toner image. The developing device 4 of the present embodiment is a reversal developing device utilizing, as a developer, a two-component developer A constituted of a magnetic carrier and a non-magnetic toner. The toner and the carrier are regulated at a predetermined weight ratio. The developer A is contained in a developing container 4*a*, and is agitated by an agitating member 4*b*, whereby the toner is charged negatively. Such developer A is supplied to a developing sleeve 4*c*, serving as a developer carrying member. The developing sleeve 4*c* is rotated counterclockwise, as indicated by an arrow, at a predetermined speed. Inside the developing sleeve 4*c*, there is provided a magnet roller 4*d* formed by a magnetic member having plural magnetic poles. The developer A, supplied onto the developing sleeve 4*c*, is carried on the surface of the developing sleeve 4*c* as a magnetic brush layer by a magnetic force of the magnet roller 4*d*, and is carried by the rotation of the developing sleeve 4*c*. In the course of such carrying, it is subjected to a layer thickness regulation by a blade 4*e*, and is further carried to a developing area, where the developing sleeve 4*c* and the image bearing member 1 are opposed each other. A predetermined development bias is applied to the developing sleeve 4*c*, from a development bias applying source 4*f*. Such bias application generates a developing electric field in the developing area, thereby separating the toner, which is sticking to the carrier, from the carrier whereby the electrostatic latent image on the image bearing member 1 is reversal developed by the negatively charged toner. In the reversal development method, a charging polarity of the photosensitive member by the charger is same as the charging polarity of the toner.

The magnetic brush layer of the developer, subjected to the development in the developing area, is returned to the developing container 4*a* by a subsequent rotation of the developing sleeve 4*c*, and is magnetically peeled off from the surface of the developing sleeve 4*c*. Then a fresh developer is supplied onto the developing sleeve 4*c*.

In the developer A contained in the developing container 4*a*, the toner concentration is lowered by a consumption of the toner in the development. For compensating such lowering, a sensor (not shown) monitors the toner concentration in the developer A of the developing container 4*a*. Then, an operation of replenishing a suitable amount of the toner from a replenishing toner container 4*g* into the developer A of the developing container 4*a* is executed intermittently when the toner concentration is lowered to an acceptable lower limit concentration. In this manner, the toner concentration is maintained within a predetermined range.

The toner image formed on the image bearing member 1 is transferred in succession, by a transfer charger 5 serving as a transfer device, onto a recording material (transfer material) P such as a sheet, supplied at a predetermined control timing from a sheet feeding portion (not shown) to an opposed portion between the image bearing member 1 and the transfer charger 5. The transfer charger 5 is given, at a predetermined control timing, a positive transfer bias, opposite to the charging polarity of the toner, from a transfer bias applying source 5*a*. Thus, the toner image on the image bearing member 1 is electrostatically transferred onto the surface of the recording material P.

The recording material P, exiting from the transfer part, is separated from the surface of the image bearing member 1 and is introduced into a fixing device 8. The fixing device 8 fixes the unfixed toner image, on the recording material P, as a permanent fixed image by heat and pressure, and then discharges the recording material P.

The image bearing member 1 after the separation of the recording material is wiped by a cleaning blade 6*a* of a cleaner 6, for the purpose of eliminating remaining deposits such as a transfer residual toner, then is subjected to a charge elimination by a flush exposure with a pre-exposure device 7, and is used for image formation again.

A control circuit (control means) 9 executes processing of signals entered from various process devices of the image forming apparatus and command signals to the various process devices, and also a predetermined image forming sequence. It also controls the apparatus according to control programs and reference tables, stored in a ROM. Various image forming conditions are entered from an operation panel 10 to the control circuit 9. The control circuit 9 also enters various information to the operation panel 10 for a display on a display unit.

(2) Charging Efficiency

In order to quantify a level of deficient charging in a following investigation, a "charging efficiency" is introduced. The charging efficiency indicates, as indicated by an equation 2, a proportion of a charge potential ΔV relative to the development contrast Vcont. The development contrast Vcont means a potential difference between a DC component of the development bias and a light potential of a portion of the photosensitive member, for constituting an image portion. The charge potential ΔV means a potential difference between a surface potential of a toner layer after the development of the latent image potential portion, and a latent image potential before the development. Thus, the charge potential ΔV of the photosensitive member corresponding to a solid image portion is a potential difference between a surface potential of the toner layer, after developing a light potential portion, which is a portion of the photosensitive member corresponding to the solid image portion, and a light potential, before the development, of a portion of the photosensitive member corresponding to the solid image portion. The measurement of potential such as a light potential and a toner layer potential is performed in a developing position or in the vicinity of the developing position by a surface potential meter.

$$\text{charging efficiency}=(\text{charge potential } \Delta V)/(\text{development contrast } V\text{cont}))\times 100(\%) \qquad \text{equation 2}$$

A method of measuring the charging efficiency will be explained. At first, an empty developing device 4, not containing the two-component developer A, is prepared, and a surface potential (latent image potential before development) on the image bearing member 1, after a charging and a latent image formation but not subjected to a developer with toner, is measured by a surface potential meter 12, provided directly below the developing device.

Then, a developing device 4, containing the two-component developer A, is prepared, and a toner image is formed on the image bearing member 1 by executing a charging and a latent image formation, and then applying a development bias. A potential (latent image potential after development) on the surface of the image bearing member immediately after the development is similarly measured with the surface potential meter 12.

Figure 9:
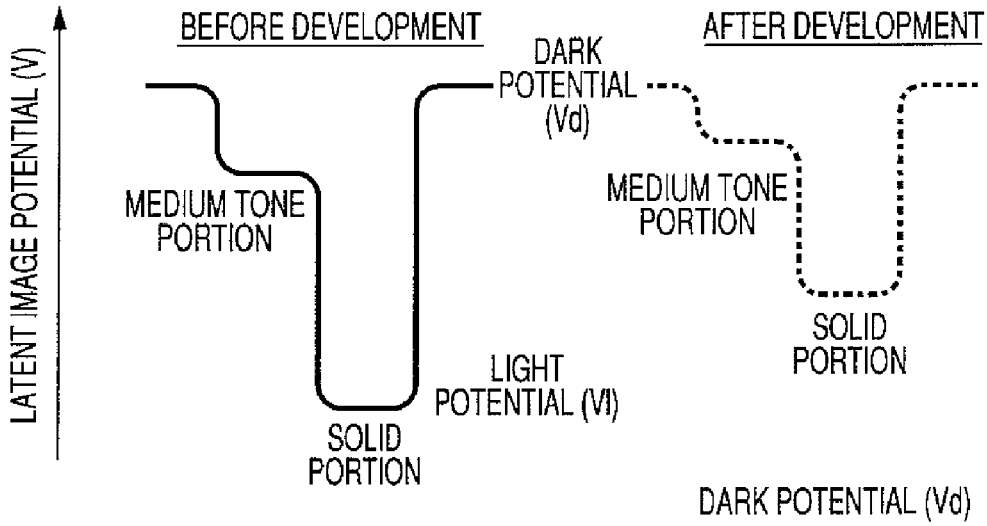
FIG. 9 is a view showing latent image potentials, obtained by a surface potential meter, before and after a development.
Figure 10:
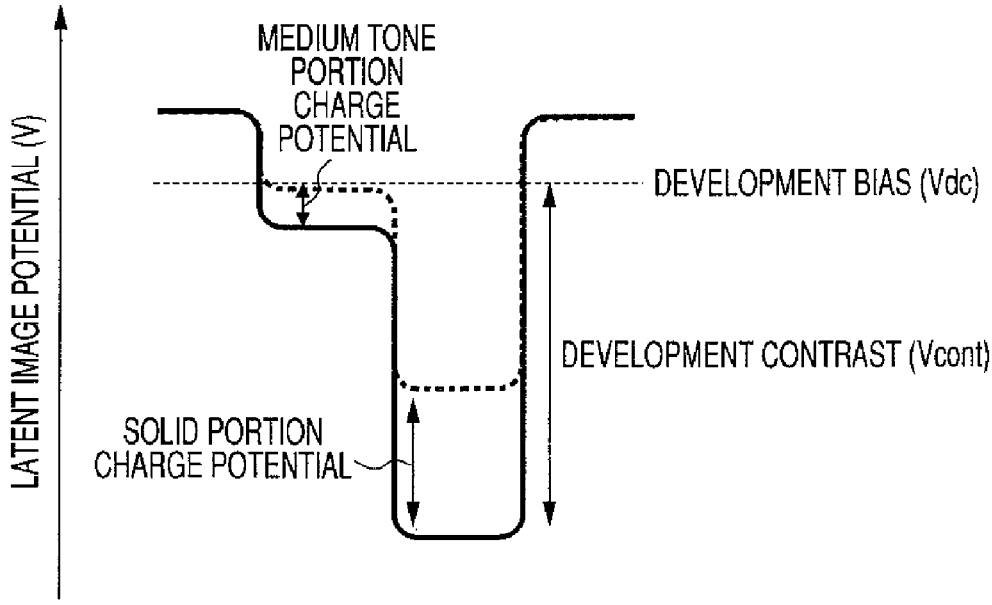
FIG. 10 is a view showing a charge potential after development.

A potential profile of the latent image potential before development and the latent image potential after development, obtained by the two methods above, is shown in FIG. 9. Then charge potentials ΔV, formed by the actual development of the electrostatic latent image with toner, can be obtained by subtracting the surface potential of the latent image potential before development and the latent image potential after development, as shown in FIG. 10.

The charging efficiency is given by a proportion of the charge potential ΔV, with respect to the development contrast Vcont which is a difference between the development bias Vdc (DC component of development bias) and the light potential Vl (cf. equation 2).

(3) Blank Area Index

Figure 4:
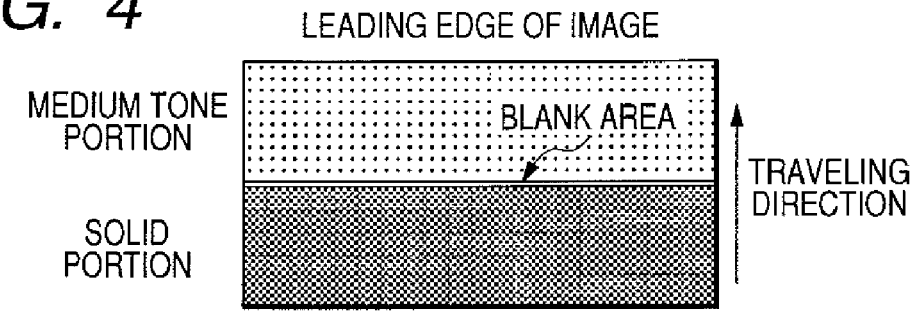
FIG. 4 is a view showing a blank area.
Figure 5:
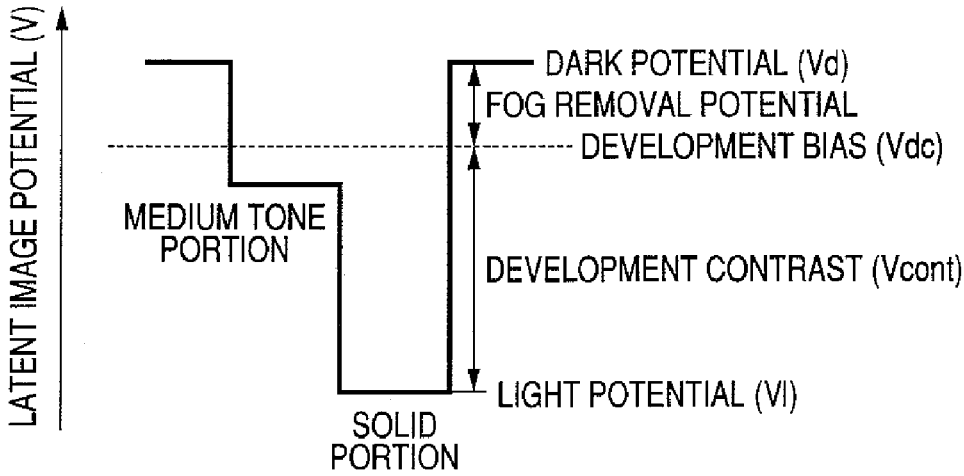
FIG. 5 is a view showing a latent image potential in a blank image area.
Figure 6:
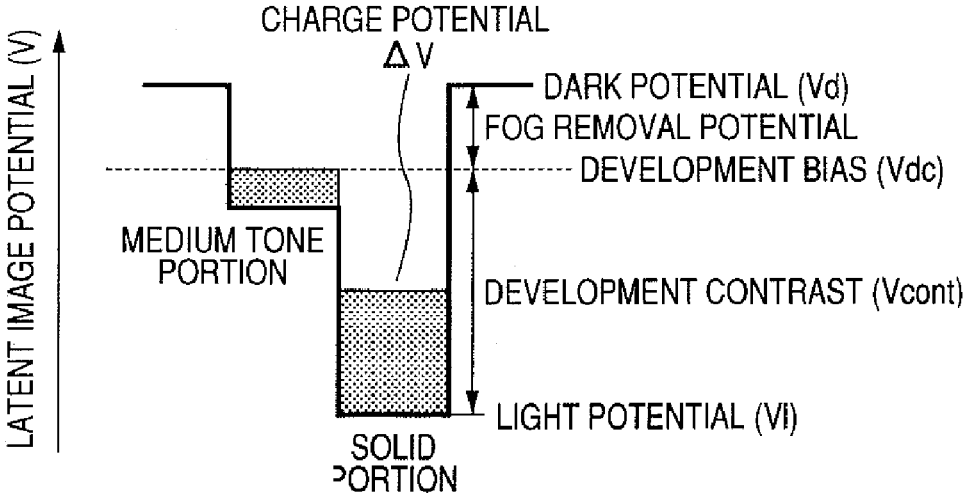
FIG. 6 is a view showing a latent image potential in a deficiently charged state.
Figure 11:
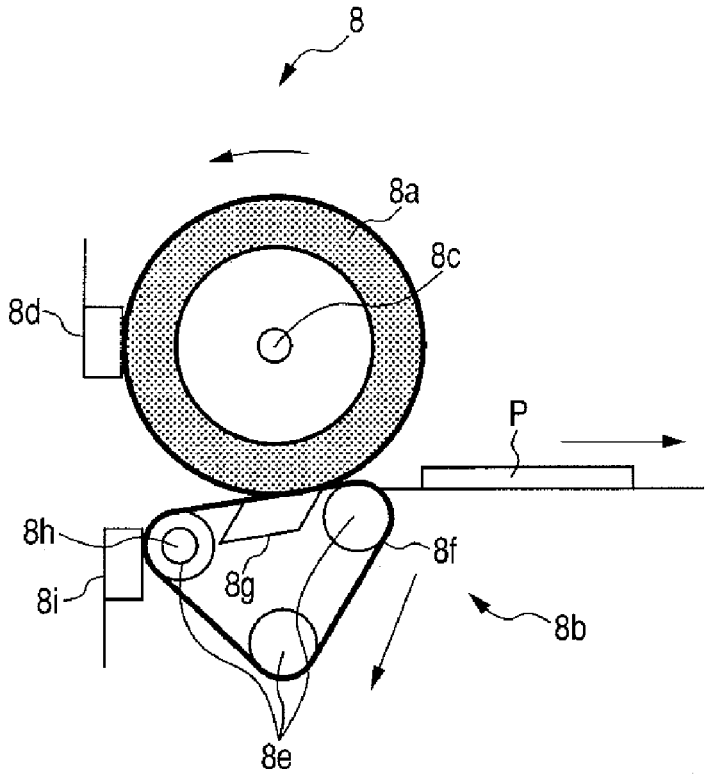
FIG. 11 is a view showing a structure of a fixing device, employed in the present invention.
Figure 12:
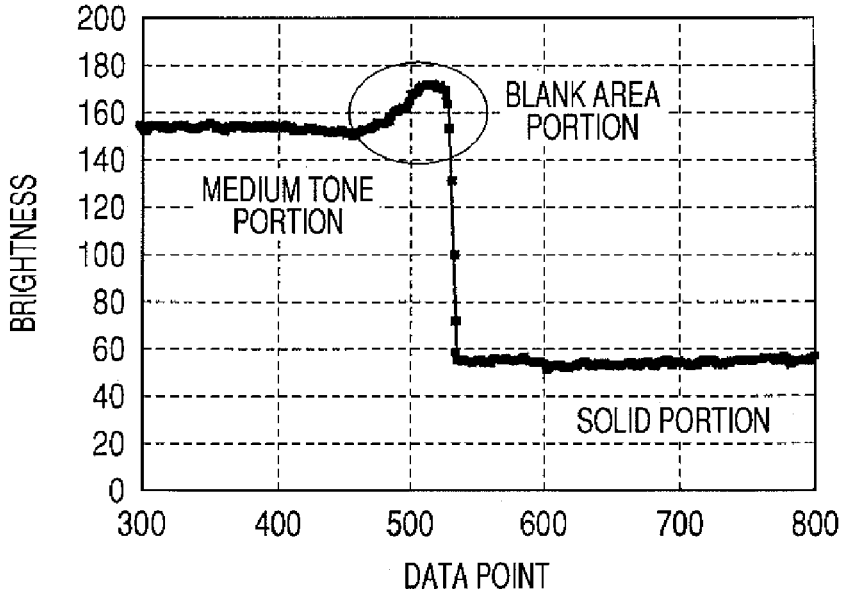
FIG. 12 is a view showing a brightness distribution of a blank image.

In order to quantify a level of blank area in a following investigation, a "blank area index" is introduced. There will be explained a method of measuring the blank area index, indicating the level of the blank area. A toner image developed on an image bearing member is transferred by a transfer charger 5 onto a recording material P (4CC ART paper of 130 g/m$^2$), and is fixed by a fixing device 8. A structure of the fixing device employed in this investigation is shown in FIG. 11. The fixing device employed in the present investigation is equipped with a fixing roller 8*a* and a pressurizing unit 8*b*, pressed in contact in the vertical direction. The fixing roller 8*a* has a two-layered structure of a releasing layer of a fluorinated resin and an underlying elastic layer. The surface layer of the fixing roller was temperature controlled at 160° C. by a halogen heater 8*c* and a thermistor 8*d*, incorporated in the fixing roller. The pressurizing unit 8*b* is constituted of three shaft rollers 8*e*, a pressurizing belt 8*f* having a releasing layer of a fluorinated resin on the surface, and a pressurizing pad 8*g*. The surface layer of the pressurizing belt at the entrance of the fixing device was temperature controlled at 110° C., by a halogen heater 8*h* and a thermistor 8*i*, incorporated in the shaft roller at the entrance of the fixing device. A blank area image (FIG. 4) on the recording material P, fixed by the fixing device described above, is read by a scanner, and a brightness distribution from a leading edge of the image toward a trailing end is obtained by a commercially available software (Adobe Photoshop) (FIG. 12). Based on the brightness distribution, an area of the blank area portion, at the boundary of the medium tone portion and the solid portion, is numerically expressed and is used as a blank area index. The medium tone portion used in this operation is subjected to a screen process or a PWM (pulse width modulation) process so as to provide a reflective density of 0.6 (measured by X-Rite spectral densitometer).

(4) Relationship of Charging Efficiency and Blank Area Index

Figure 13:
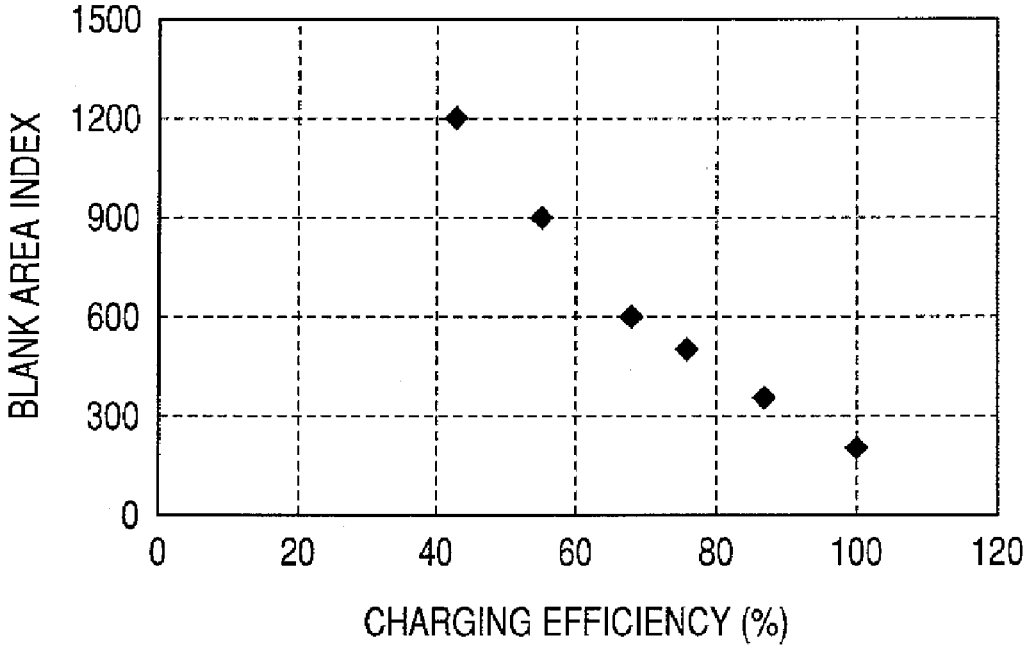
FIG. 13 is a view showing a relationship between a blank area index and a charging efficiency.

FIG. 13 shows a result of investigation on the relationship between the charging efficiency and the blank area index. As a result of investigations under various developing conditions, it is found that the charging efficiency and the blank area index have a relationship regardless of the developing condition, and that an increase in the charging efficiency reduces the blank area index, thus achieving an improvement in the blank area.

As a result of investigation on the acceptable level of the blank area, it is found that, in a visual observation, a blank area index of 300 or less is in an acceptable level. Stated differently, a charging efficiency of 90% or more provides a blank area in the acceptable level.

The charging efficiency and the blank area index, obtained in the following Embodiments, are all obtained by the methods described in (2) and (3) above.

(5) Embodiment 1

In this Embodiment 1, the development in a solid portion is executed on a latent image of an irregularity structure, obtained by a screen (line) process that has ordinarily been employed in a highlight portion and a medium tone portion. In such development, there is employed toner of a same amount as in the development of a solid portion in the conventional method. It is therefore featured in realizing, in a solid portion, an irregularity structure having a higher toner layer and including also an air layer in addition to the toner layer.

Figure 14:
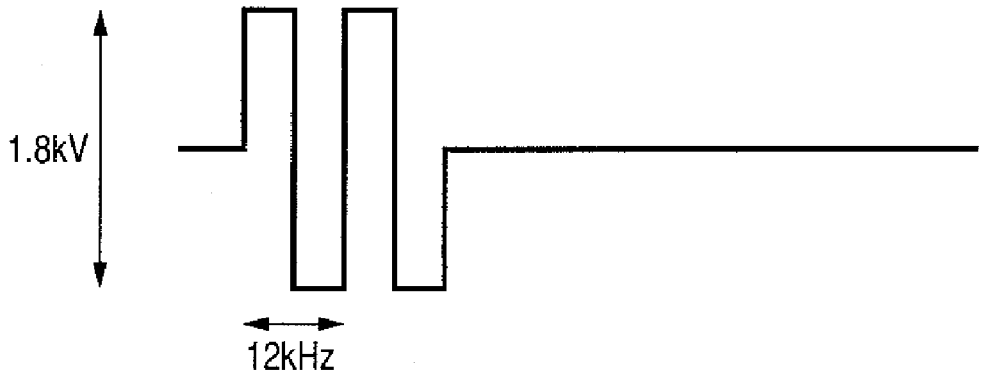
FIG. 14 is a waveform chart showing a development bias employed in Embodiments.

Results of the investigation will be explained. As the testing apparatus, there was employed a modified iRC-6800 apparatus, utilizing a digital image exposure process and a reversal developing process. The used image bearing members include an organic photoreceptor and an α-Si photoreceptor, explained below. The organic photoreceptor had a film thickness dm of 28 μm, a relative permittivity $\epsilon_m$ of 3.3, and a capacitance C/S per unit area of $1.0\times10^{-6}$ (F/m$^2$). The α-Si photoreceptor had a film thickness dm of 30 μm, a relative permittivity $\epsilon_m$ of 10, and a capacitance C/S per unit area of $3.0\times10^{-6}$ (F/m$^2$). The film thickness dm was measured with an eddy current-type film thickness meter (manufactured by Fischer Instruments K.K.). The capacitance C/S per unit area was measured with an LCR meter (AG-4304, manufactured by Ando Electric Co., Ltd.). More specifically, it was measured on a flat plate-shaped photosensitive plate, having a layer structure same as that in the actual image bearing member, on an Al base of about 1 cm$^2$ (frequency: 100 Hz, applied voltage: 1 V). The relative permittivity $\epsilon_m$ was determined from the capacitance C, based on a known film thickness dm of the image bearing member. A distance (SD gap) between the developing sleeve 4*c* and the image bearing member 1 was 300 μm. The development bias employed in this operation had a waveform, including a DC component superposed with an AC component, as shown in FIG. 14. The AC component had a frequency of 12 kHz and a peak-to-peak voltage Vpp of 1.8 kV.

Figure 15:
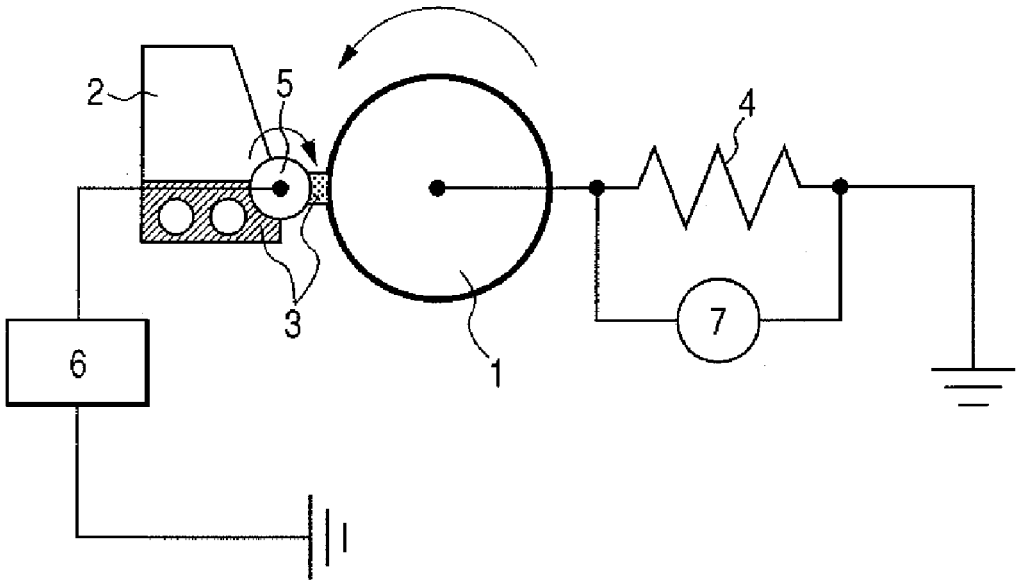
FIG. 15 is a view showing a resistance measuring method.

In the following, a developer employed in this embodiment will be explained. The developer employed was a two-component developer constituted of a non-magnetic toner and a magnetic carrier. The employed non-magnetic toner was a toner prepared by a known crushing method. On the other hand, the magnetic carrier employed was a resinous carrier. A type and a thickness of a carrier surface coating were so regulated as to obtain a volume resistivity of $5\times10^9$ Ω·cm or larger, since a volume resistivity of the magnetic carrier smaller than $5\times10^9$ Ω·cm causes, on the α-Si photoreceptor having a low surface resistance, a perturbation in the latent image by the development bias at the developing operation. In the following, a method of measuring the volume resistivity will be explained. In a structure similar to that of the testing apparatus as shown in FIG. 15, an Al image bearing member 1 is provided, and a magnetic carrier 3 alone is placed in a developing device 2. The Al image bearing member 1 is connected to a known resistor 4 (10 kΩ) and is then grounded. In a state where the developing sleeve 5 and the Al image bearing member 1 are rotated under conditions same as those of the testing apparatus, a DC voltage is applied to the developing sleeve 5 from a power source 6. In this state, a voltage applied to the known resistor 4 is measured by a voltmeter 7 to determine a current flowing in the magnetic carrier 3, trapped between the developing sleeve 5 and the Al image bearing member 1, whereby the resistance can be determined from the applied DC voltage. Also the volume resistivity can be determined from a contact area between the magnetic carrier and the image bearing member, the SD gap and the above-mentioned resistance. The volume resistivity determined by this method is a value under an application of DC voltage −600V (electric field strength of $2\times10^4$ V/cm). In the two-component developer employed in the present embodiment, the mixing ratio of the non-magnetic toner and the magnetic carrier was so regulated that the non-magnetic toner represents about 10% of the total weight. In such state, the toner had a triboelectric charge amount of about −45 μC/g.

Under these conditions, the surface of the photosensitive member was uniformly charged, by a primary charger 2, to a dark potential Vd. Then, in order to form a conventional flat latent image in a solid portion, data of single color (cyan) of 100% (conventional solid image), prepared with a commercially available software (Adobe Photoshop), were supplied to the testing apparatus. In this operation, the laser power was varied to regulate the potential in the solid portion at the light potential Vl, thereby securing a necessary development contrast and a fog removal potential. The fog removal potential Vback means a potential difference between the DC component Vdc of the development bias and the dark potential Vd, and was investigated at 150 V. Table 1 shows, in the developments conducted under same conditions on the organic photoreceptor and the α-Si photoreceptor, measured values when the developed toner amount (M/S) per unit area on the image bearing member 1 was 0.6 mg/cm$^2$. Thus, Table 1 shows a case where the latent image in the solid portion was so formed that the toner does not have an irregularity structure but has a conventional flat structure.

TABLE 1

| image bearing member | Vcont | Q/M | M/S | actually measured ΔV | actually measured charging efficiency |
|---|---|---|---|---|---|
| OPC | 300 V | −45 μC/g | 0.6 mg/cm$^2$ | 300 V | 100% |
| α-Si | 200 V | −45 μC/g | 0.6 mg/cm$^2$ | 140 V | 70% |

Figure 16:
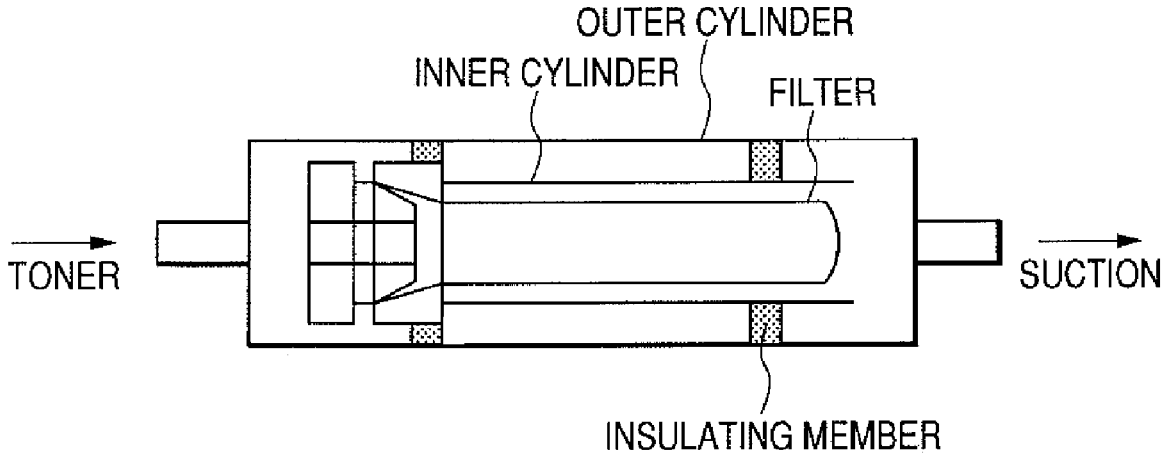
FIG. 16 is a schematic view of a Faraday gauge employed for measuring Q/M and M/Q.

Measuring methods for Q/M and M/S will be explained below. A Faraday gauge shown in FIG. 16 is provided with double cylinders, constituted of metal cylinders of different diameters arranged concentrically, and a filter for sucking the toner into the inner cylinder. When the toner on the image bearing member (photosensitive member) is fetched into the filter by air suction, an electrostatic induction is generated by the charge amount Q of the toner, as the inner cylinder and the outer cylinder are insulated. The charge amount thus induced was measured by Keithley 616 Digital Electrometer, and was divided by a toner weight M in the inner cylinder to obtain Q/M (μC/g). Also the sucked area on the image bearing member was measured and was used to divide the toner weight M to obtain M/S (mg/cm$^2$).

In a comparison of the organic photoreceptor (OPC) and the α-Si photoreceptor, it is found that, as shown in Table 1, the development on the organic photoreceptor is properly terminated with a charging efficiency of 100%, while the development on the α-Si photoreceptor is terminated in an uncharged state (charging efficiency of 70%). It is also found that the α-Si photoreceptor, being in an uncharged state and not terminating the development in a proper state in the developing area, results in a larger developed toner amount (M/S) and a smaller development contrast (Vcont) for developing the necessary toner amount, in comparison with the organic photoreceptor.

Figure 17:
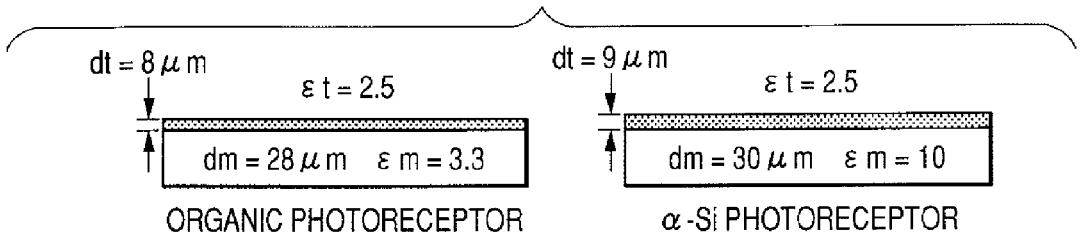
FIG. 17 is a view showing toner layers on the image bearing member by a conventional latent image.

Then, the properness of the measured charging potential was confirmed. A toner layer height dt and a relative permittivity $\epsilon_r$ of the toner layer, measured on the image bearing member, were substituted in the theoretical equation 1 to obtain a theoretical charging potential ΔVth, which was compared with the measured charging potential ΔV. In the substitution of numerical values into the equation 1, dimensions have to be suitably matched. Measuring method will be explained below. The toner layer height on the image bearing member was determined by observing the toner layer, utilizing an ultra-deep 3D-shape measuring microscope of Keyence Inc. Observed states are shown in FIG. 17. Both on the organic photoreceptor and on the α-Si photoreceptor, the toner layer on the image bearing member was formed flat, with a toner layer height dt of 8 μm in the case of the organic photoreceptor and 9 μm in the case of the α-Si photoreceptor. The toner layer height is larger in the α-Si photoreceptor than in the organic photoreceptor presumably because, as the charge diffusion is suppressed in the α-Si photoreceptor, the latent image is formed deeper and more stable, thereby allowing the toner layer to heap up higher. Also the relative permittivity $\epsilon_r$ of the toner layer was measured on toner, formed as a toner layer of a thickness of about 1 mm sandwiched between electrodes of a cross section of about 2.3 cm$^2$, by an LCR meter (AG-4304, manufactured by Ando Electric Co., Ltd.). The toner layer showed a relative permittivity $\epsilon_r$ of 2.5. Table 2 shows results of substitution of the parameters into the theoretical equation 1.

TABLE 2

| image bearing member | Q/S | dt | actually measured ΔV | theoretical ΔV | blank area index |
|---|---|---|---|---|---|
| OPC | $2.7 \times 10^{-2}$ μC/cm$^2$ | 8 μm | 300 V | 308 V | 200 |
| α-Si | $2.7 \times 10^{-2}$ μC/cm$^2$ | 9 μm | 140 V | 146 V | 600 |

It can be seen that the theoretical value of ΔV satisfactorily reproduces the actually measured value. Also as a result of measurement of the blank area index on blank area images after fixation, by the measuring method described above, it was found that the organic photoreceptor provided a blank area index of 200 which was in the acceptable level, while the α-Si photoreceptor provided a blank area index of 600, which was significantly outside the acceptable level.

In the present embodiment, therefore, in order to solve the deficient charging in the solid portion, a conventional flat latent image is not formed in the solid portion, but a latent image having an irregularity structure, formed by a screen (line) process as used in the highlight portion and in the medium tone portion, is used for development. In such case, the development is made with a toner amount same as in developing a conventional solid portion. In this manner, in comparison with the solid portion having the conventional flat toner layer, the toner layer is made higher and is given an irregularity structure including an air layer in addition to the toner layer.

In the following, details of the present embodiment will be explained. Under the aforementioned conditions, the surface of the α-Si photoreceptor was uniformly charged by the primary charger to a dark potential of −530 V (Vd). Then, in order to form a latent image having an irregularity structure on the solid portion, monochromatic (cyan) 1-line 1-space data of a resolution of 600 dpi, prepared with a commercially available software (Adobe Photoshop), were introduced to the testing apparatus. The 1-line 1-space image means latent images of lateral lines, extending perpendicularly to the rotating direction of the photosensitive member, formed by alternately turning on the laser beam for one line and turning off for one line. Thus the latent images of the lateral lines are formed with a blank en one every other line. Since the resolution is 600 dpi, 1 line (or 1 space) has a width of about 42 μm (1 inch/600). The laser power was so varied as to regulate the potential of the solid portion at −130 V (Vl=light potential), thereby securing a necessary development contrast (Vcont) of 250 V and a fog removal potential (potential difference between dark potential and DC component of development bias) of 150 V. In the following, actually measured values are shown in a case where, in the development, the developed toner amount (M/S) per unit area, namely the toner developed on the image bearing member 1, was 0.6 mg/cm$^2$. The actually actual measured values of the present embodiment, having an irregularity structure on the toner layer, include not only portions corresponding to the protruded portions of the toner layer but also the recessed portions thereof.

TABLE 3

| toner image | Vcont | Q/M | M/S | actually measured ΔV | actually measured charging efficiency |
|---|---|---|---|---|---|
| flat (conventional) | 200 V | −45 μC/g | 0.6 mg/cm$^2$ | 140 V | 70% |
| irregularity (the invention) | 250 V | −45 μC/g | 0.6 mg/cm$^2$ | 233 V | 93% |

In case of development on the latent image having the irregularity structure, as shown in Table 3, the development contrast Vcont required for developing a same amount of toner increased to 250 V. This is presumably ascribable to a fact that the charging performance is improved whereby the development is terminated closer to the proper state. It was also found that, despite of a developed toner amount of same Q/S (=(Q/M)×(M/S)), the charging efficiency was drastically improved in comparison with the solid portion having the flat structure.

Figure 18:
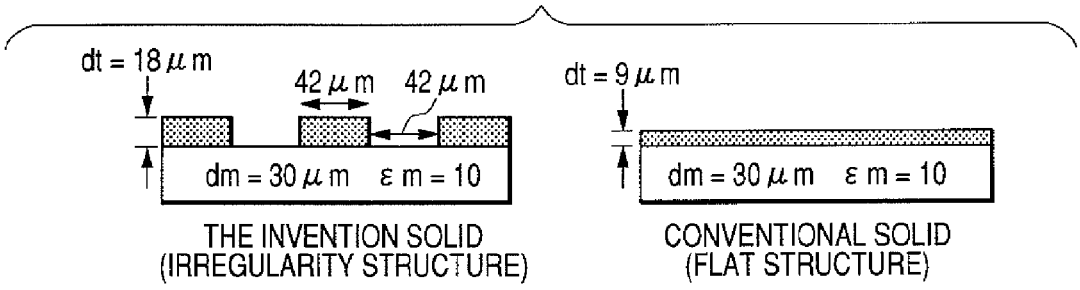
FIG. 18 is a view showing toner layers on the image bearing member, formed by an image processing (1 line-1 space).

Then, in order to confirm the properness of the actually measured charge potential, a comparison was made between a theoretical value ΔVth of the charge potential according to the equation 1 and the measured charge potential ΔV. FIG. 18 shows results of observation of the toner layer by the aforementioned measuring method. It was confirmed that the toner layer on the image bearing member was completely interspaced (thinned), constituting an irregularity structure. In this case, no toner is present at all in a recessed portion in such irregularity structure. In a protruded portion of the irregularity structure, the toner layer height dt was 18 μm. In FIG. 18, a lateral direction corresponds to the sub-scanning direction of the photosensitive member.

TABLE 4

| toner image | Q/S | dt | actually measured ΔV | theo-retical ΔV | blank area index | solid portion quality |
|---|---|---|---|---|---|---|
| flat | $2.7 \times 10^{-2}$ μC/cm$^2$ | 9 μm | 175 V | 170 V | 600 | ○ |
| irregularity | $2.7 \times 10^{-2}$ μC/cm$^2$ | 18 μm | 233 V | 203 V | 300 | ○ |

○: good

As shown in Table 4, the theoretical value of ΔV (203 V) is significantly different from the measured value (233 V). This is presumably ascribable to a fact that the toner layer of the irregularity structure is influenced by the air layer (relative permittivity: 1), and shows an increase in the charge potential corresponding to a decrease in the apparent permittivity of the toner layer. On the fixed image having a blank area, a blank area index was measured by the aforementioned measuring method. It was found that the blank area index was improved to an acceptable level of 300 by forming an irregularity structure in the solid portion, as shown in a left-hand part in FIG. 18. Then the solid portion after fixation was observed under a digital microscope (Keyence VH-8000) to confirm whether the screen structure was erased. Also a reflective density was measured with X-Rite spectral densitometer to confirm that the reflective density was 1.9 or higher, which was acceptable as a solid portion. As a result, it was confirmed that the screen structure was erased and the reflective density was 1.9 or higher, whereby the solid portion had a sufficiently acceptable quality. In the following, the acceptable quality level for the solid portion is judged according to the method described above.

Line-space data of 5×5 matrix of a resolution of 600 dpi were prepared with a commercially available software (Adobe Photoshop), and were used, as a solid image, for an image output on the testing apparatus. Measuring conditions are same as those described above.

TABLE 5

| charging efficiency/dt | 1 line | 2 lines | 3 lines | 4 lines | 5 lines |
|---|---|---|---|---|---|
| 1 space | 93%/ 18 μm | 90%/ 15 μm | 80%/ 12 μm | 76%/ 11 μm | 72%/ 10 μm |
| 2 spaces | — | 95%/ 18 μm | 91%/ 16 μm | 87%/ 14 μm | 84%/ 13 μm |
| 3 spaces | — | — | 95%/ 18 μm | 92%/ 17 μm | 90%/ 15 μm |
| 4 spaces | — | — | — | 95%/ 18 μm | 92%/ 17 μm |
| 5 spaces | — | — | — | — | 95%/ 18 μm |

Table 5 shows measured results of the charging efficiency and the toner layer height dt in each of screen processes with various combinations of the number of lines and the number of spaces in the lateral image pattern. However, a screen condition, incapable of securing the necessary development contrast and the fog removal potential even by varying the laser power, is indicated by sign-in the table. The charging efficiency decreases by an increase in the line width under a constant space width. This is presumably because an increase in the line width suppresses an increase in the height. On the other hand, the charging efficiency increases by an increase in the space width under a constant line width. This is presumably because an increase in the space width facilitates an increase in the height.

TABLE 6

| solid portion quality | 1 line | 2 lines | 3 lines | 4 lines | 5 lines |
|---|---|---|---|---|---|
| 1 space | ○ | ○ | ○ | x | x |
| 2 spaces | — | ○ | ○ | x | x |
| 3 spaces | — | — | x | x | x |
| 4 spaces | — | — | — | x | x |
| 5 spaces | — | — | — | — | x |

○: good
x: bad

Table 6 shows result of solid portion quality in each screen process, judged according to the acceptable level above. The quality of the solid portion after fixation is in an acceptable level depending on the line width when the space width is 84 μm or less, namely 2 spaces or less, but the quality of the solid portion after fixation is less than the acceptable level, when the space width is 126 μm or more, namely 3 spaces or more.

Thus, based on the results in Tables 5 and 6, for the quality of the solid portion and the charging efficiency, it is preferable, at a resolution of 600 dpi, that the toner layer height dt on the line is 15 μm or more for a space width of 42 μm (namely 1 space). Thus, in Table 5, conditions of 1-line-1-space and 2-line-1-space are preferred. Also based on the result in Tables 5 and 6, the toner layer height dt on the line is preferably 16 μm or more for a space width of 84 μm (namely 2 spaces). Thus, in Table 5, conditions of 2-line-2-space and 3-line-2-space are preferred.

Figure 23:
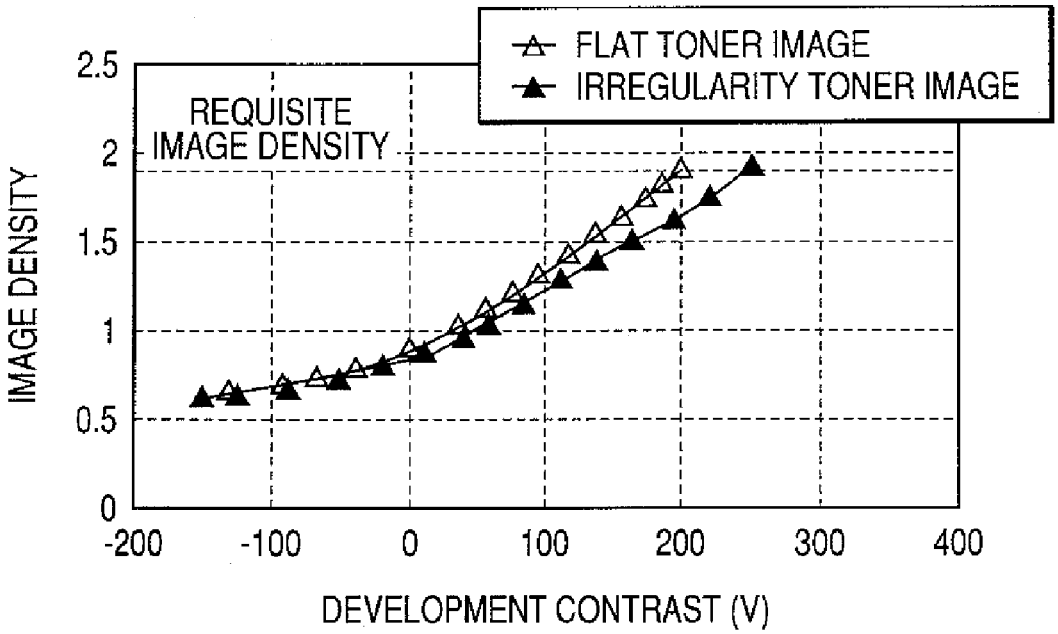
FIG. 23 is a view showing a V-D curve in an α-Si photoreceptor obtained in Embodiment 1, when a development contrast of 250 V is applied.

In case of forming an irregularity structure in the solid portion by a screen process, a sufficient tone reproducibility can naturally be secured in the highlight portion and in the medium tone portion, by the screen process. FIG. 23 shows a V-D curve (image density as a function of development contrast at arbitrary 16 tone levels among 256 tone levels), in a 1-line-1-space screen process for the solid portion, when the highlight portion and the medium tone portion are so screen processed as to have a sufficient tone reproducibility. It was confirmed that, in comparison with a conventional system of low charging performance (flat toner image in solid portion), the V-D curve became flatter in the present embodiment (irregularity toner image in the solid portion) because of the improved charging performance. It is also possible to secure the tone reproducibility further, by combining the dither method and the pulse width modulation or the intensity modulation in the multilevel recording method.

The present embodiment has shown an example of a screen (line) process with a resolution of 600 dpi, but any means or any tone reproducing method may be employed without restriction as long as an irregularity structure is given to the toner image in the solid portion.

(6) Embodiment 2

Figure 19:
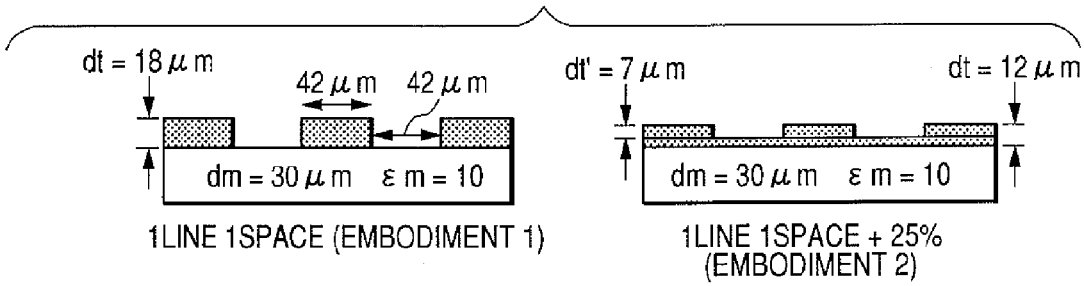
FIG. 19 is a view showing toner layers on the image bearing member, formed by an image processing (1 line-1 space).

In Embodiment 2, an investigation was made without a complete interspacing (thinning) in the Embodiment 1 of the toner image on the image bearing member. More specifically, in the solid portion employed in Embodiment 1 (line-space resolution of 600 dpi), the laser beam was so modulated as to execute an irradiation with a lowered intensity even in a portion corresponding to a white background portion formed by spaces. Thus a toner layer was formed even in a recessed portion in the irregularity structure of the toner layer. Results are shown in FIG. 19. It was confirmed that the toner layer on the image bearing member had an irregularity structure, without a complete interspacing (thinning). More specifically, toner is not formed in the recessed portion in Embodiment 1, while toner is formed in the recessed portion in Embodiment 2. A measured charging efficiency, a difference dt' between a toner layer height in the recessed portion and a toner layer height in the protruded portion, and a toner layer height dt in the protruded portion, in each screen process, are shown in this order in Table 7.

TABLE 7

| charging efficiency/ dt'/ dt | 1 line | 2 lines |
|---|---|---|
| 1 space | 82%/7 μm /12 μm | 73%/5 μm/10 μm |
| 2 spaces | 95%/16 μm/20 μm | 80%/7 μm/12 μm |

In comparison with Embodiment 1, the toner layer height dt (protruded portion) decreases because of a spreading in the toner developing area. For this reason, the charging efficiency decreases in comparison with Embodiment 1.

Then, Table 8 shows the quality of the solid portion in each screen process, judged according to the aforementioned acceptable level.

TABLE 8

| solid portion quality | 1 line | 2 lines |
|---|---|---|
| 1 space | x | x |
| 2 spaces | ○ | x |

○: good
x: bad

The quality of the solid portion after fixation was in an acceptable level only in a screen process of 1 line and 2 spaces. The quality of the solid portion was less than the acceptable level in other screen processes, presumably ascribable to a fact that the difference dt' in the toner layer height between the protruded and recessed portions is outside the range in Embodiment 1.

Thus, as explained in Tables 5 and 6 in Embodiment 1, the difference dt' in the toner layer height between the protruded and recessed portions is preferably 12 μm or more, for a resolution of 600 dpi and a space width of 42 μm. Also the difference dt' in the toner layer height between the protruded and recessed portions is preferably 16 μm or more, for a space width of 84 μm.

(7) Embodiment 3

In contrast to Embodiment 1 (utilizing a screen structure formed by lines), Embodiment 3 employed a screen structure, formed by dots, for the development in the solid portion. Other conditions were same as those in Embodiment 1. Table 9 shows results of comparison of a 2-dot-1-space process with the 2-line-1-space process in Embodiment 1, and comparison of a 3-dot-1-space process with the 3-line-1-space process in Embodiment 1. The 2-dot-1-space process is executed by turning on the laser beam continuously for 2 dots and then turning off for 1 dot in repetition along the main scanning direction of the photosensitive member, and the 3-dot-1-space process is executed by turning on the laser beam continuously for 3 dots and then turning off for 1 dot in repetition along the main scanning direction of the photosensitive member. Thus, the number of spaces in this case means a number of turn-offs of the laser beam in the main scanning direction. A number of spaces in Embodiment 1 means, as explained in Embodiment 1, a number of turn-off lines of the laser beam in the sub scanning direction. Therefore, a 2-line-1-space process means turning on the laser beam continuously for 2 lines and then turning off for 1 line in repetition along the sub scanning direction.

TABLE 9

| screen | charging efficiency | toner layer height dt | solid portion quality |
|---|---|---|---|
| 2-line-1-space (Embodiment 1) | 90% | 15 μm | ○ |
| 2-dot-1-space (Embodiment 3) | 92% | 17 μm | ○ |
| 3-line-1-space (Embodiment 1) | 80% | 12 μm | ○ |
| 3-dot-1-space (Embodiment 3) | 84% | 13 μm | x |

○: good
x: bad

It was found that, for each condition, a screen structure formed by dots (Embodiment 3) showed an improved charging efficiency in comparison with a screen structure formed by lines (Embodiment 1). This is presumably because a structure formed by dots has a larger space (white background) area in comparison with that formed by lines, whereby the toner layer is developed with a larger height dt for a same developed toner amount. It is also because, in the toner layer on the image bearing member, a structure formed by dots has a larger volume of air layers in comparison with that formed by lines, whereby the apparent permittivity of the toner layer decreases corresponding to the larger volume of the air layers. As shown in Table 9, a 2-dot-1-space structure provided satisfactory results on the image density in the solid portion and on the charging efficiency. It is however found that, in a structure formed by dots, the screen structure in the solid portion tends to remain after the fixation because of a larger space area, and that the quality of the solid portion is difficult to maintained as in the case of 3-dot-1-space structure.

The present embodiment has shown an example of a screen process by line formation and dot formation with a resolution of 600 dpi, but any means or any tone reproducing method may be employed without restriction as long as an irregularity structure is given to the toner image in the solid portion. Thus, regardless whether the screen structure is formed by lines or dots, any screen process, capable of generating an irregularity structure in the toner image of the solid portion, is included in the scope of the appended claims. Also an error diffusion process or the like, not having a screen structure, as long as capable of generating an irregularity structure in the toner image of the solid portion, is included in the scope of the present invention.

(8) Embodiment 4

In this Embodiment 4, the development in a solid portion is executed on a latent image of an irregularity structure, obtained by a pulse width modulation. In such development, there is employed toner of a same amount as in the development of a solid portion having the conventional solid portion. Thus, in contrast to the solid portion having a conventional flat developed toner layer, there was formed an irregularity structure having a higher toner layer and including also an air layer in addition to the toner layer. More specifically, in the latent image formation in the solid portion, the laser is not continuously turned on ((1-3) in FIG. 3) for forming a flat latent image (2-3) in FIG. 3) as in the conventional process, but executes the exposure with an oscillation time as conventionally utilized in a medium tone ((1-1) and (1-2) in FIG. 3). A latent image thus formed ((2-1), (2-2) in FIG. 3) is developed with a same amount of toner to realize an irregularity structure having a higher toner layer and also including an air layer in addition to the toner layer.

Result of investigation will be explained. As the testing apparatus, there was employed a modified CLC-5000 apparatus, incorporating a pulse width modulation with a resolution of 200 lines, and utilizing a digital image exposure process and a reversal developing process for the development.

The used image bearing members include an organic photoreceptor and an α-Si photoreceptor, explained below.

The organic photoreceptor had a film thickness dm of 28 μm, a relative permittivity $\epsilon_m$ of 3.3, and a capacitance C/S per unit area of $1.0\times10^{-6}$ (F/m$^2$).

The α-Si photoreceptor had a film thickness dm of 30 μm, a relative permittivity $\epsilon_m$ of 10, and a capacitance C/S per unit area of $3.0\times10^{-6}$ (F/m$^2$).

The film thickness dm and the relative permittivity $\epsilon_m$ were measured by the methods described above.

Conditions of SD gap, development bias, two-component developer and the like are similar to those in Embodiments 1, 2 and 3.

Under these conditions, the surface of the photosensitive member was uniformly charged, by a primary charger 2, to a dark potential Vd. Also as a comparative example, in order to form a flat latent image in the solid portion, an exposure was made, in the latent image formation by a laser scan exposure, by a continuous turn-on of the laser with an oscillation time of FFh. In this operation, the laser power was varied to regulate the potential in the solid portion at the light potential Vl, thereby securing a necessary development contrast and a fog removal potential (150 V). Table 10 shows, in the developments conducted under same conditions on the organic photoreceptor and the α-Si photoreceptor as comparative examples, measured values when the developed toner amount (M/S) per unit area on the image bearing member 1 was 0.6 mg/cm$^2$.

TABLE 10

| image bearing member | Vcont | Q/M | M/S | actually measured ΔV | actually measured charging efficiency |
|---|---|---|---|---|---|
| OPC | 300 V | −45 μC/g | 0.6 mg/cm$^2$ | 300 V | 100% |
| α-Si | 200 V | −45 μC/g | 0.6 mg/cm$^2$ | 140 V | 70% |

In a comparison of the organic photoreceptor and the a-Si photoreceptor, it is found that, as shown in Table 10, the development on the organic photoreceptor is properly terminated with a charging efficiency of 100%, while the development on the α-Si photoreceptor is terminated in an uncharged state (charging efficiency of 70%). It is also found that the α-Si photoreceptor, being in an uncharged state and not terminating the development in a proper state in the developing area, results in a larger developed toner amount (M/S) and a smaller development contrast for developing the necessary toner amount, in comparison with the organic photoreceptor.

Figure 20:
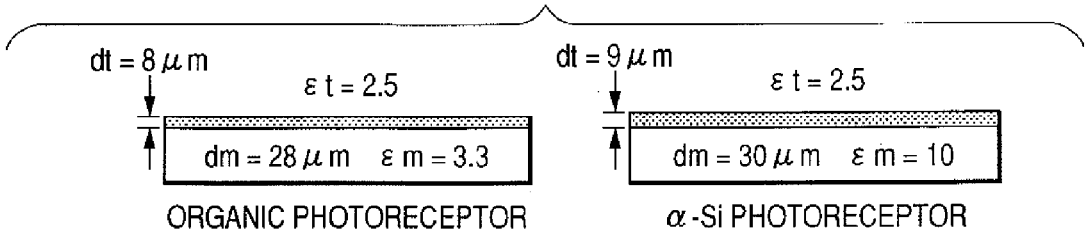
FIG. 20 is a view showing toner layers on the image bearing member by a conventional latent image.

Then, the properness of the actually measured charging potential was confirmed. An actually measured toner layer height dt and an actually measured relative permittivity $\epsilon_t$ of the toner layer on the image bearing member, were substituted in the theoretical equation 1 to obtain a theoretical charging potential ΔVth, which was compared with the actually measured charging potential ΔV. Measuring methods for the toner layer height dt and the relative permittivity $\epsilon_t$ are the same as explained above. Results of observation of the toner layer are shown in FIG. 20. Both on the organic photoreceptor and on the α-Si photoreceptor, the toner layer on the image bearing member was formed flat, with a toner layer height dt of 8 μm for the organic photoreceptor and 9 μm for the α-Si photoreceptor. The toner layer height is larger in the α-Si photoreceptor than in the organic photoreceptor presumably because, as the charge diffusion is suppressed in the α-Si photoreceptor, the latent image is formed deeper and more stable, thereby allowing the toner layer to heap up higher. Table 11 shows results of substitution of the parameters into the theoretical equation 1.

TABLE 11

| image bearing member | Q/S | dt | actually measured ΔV | Theorerical ΔV | blank area index |
|---|---|---|---|---|---|
| OPC | $2.7\times10^{-2}$ μC/cm$^2$ | 8 μm | 300 V | 308 V | 200 |
| α-Si | $2.7\times10^{-2}$ μC/cm$^2$ | 9 μm | 140 V | 146 V | 600 |

It can be seen that the theoretical value of ΔV satisfactorily reproduces the measured value. Also as a result of measurement of the blank area index on blank area images after fixation, by the measuring method described above, it was found that the organic photoreceptor provided a blank area index of 200 which was in the acceptable level, while the α-Si photoreceptor provided a blank area index of 600, which was significantly outside the acceptable level.

Figure 3:
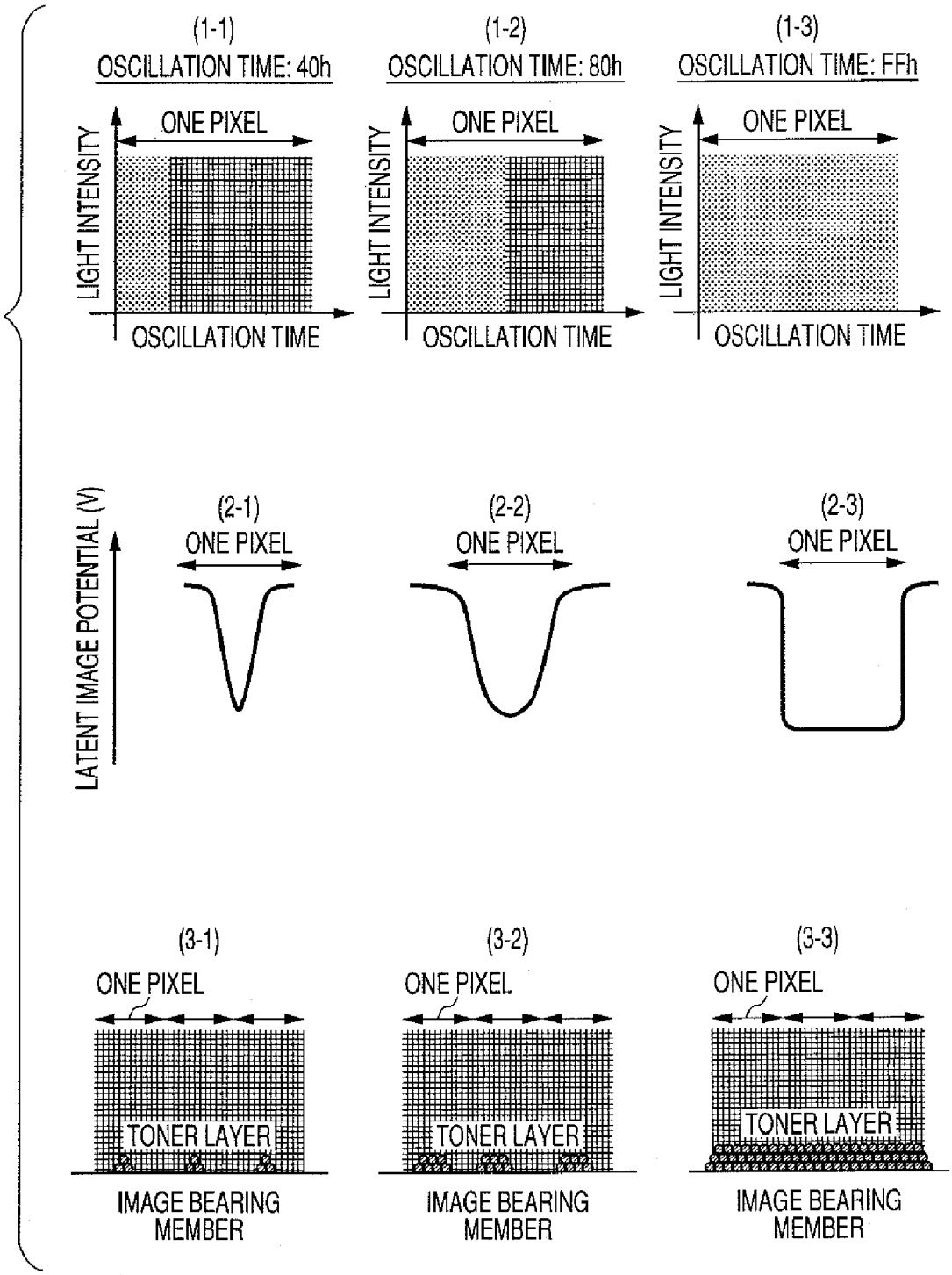
In FIG. 3, (1-1) to (1-3) are views showing relations between a laser oscillation time and a light intensity in a pulse width modulation (at 40h, 80h and FFh among 256 tone levels); (2-1) to (2-3) in FIG. 3 are views showing a latent image potential of a pixel, at oscillation times of 40h, 80h and FFh; and (3-1) to (3-3) in FIG. 3 are views showing a toner layer on an image bearing member, at oscillation times of 40h, 80h and FFh.

Then, in order to solve the deficient charging in the solid portion, a flat latent image ((2-3) in FIG. 3) is not formed in the solid portion, but a latent image employed in a medium tone portion as shown in (2-1) and (2-2) in FIG. 3, is used as Embodiment 4 for the development. In such case, the development is made with a toner amount same as in developing a conventional solid portion. In this manner, in comparison with the solid portion having the conventional flat developed toner layer, the toner layer is made higher and is given an irregularity structure including an air layer in addition to the toner layer.

In the following, details of the present embodiment will be explained. Under the aforementioned conditions, the surface of the α-Si photoreceptor was uniformly charged by the primary charger 2 to a dark potential of −575 V (Vd=dark potential). Then, an exposure in the solid portion was executed with an oscillation time of 80h, shorter than the oscillation time (FFh) for forming a flat latent image. In this operation, the solid portion had a potential of −175 V (Vl=light potential), thereby securing a necessary development contrast of 250 V and a fog removal potential of 150 V. In the following, actually measured values are shown in a case where, in the development, the developed toner amount (M/S) per unit area was 0.6 mg/cm$^2$.

TABLE 12

| toner image | Vcont | Q/M | M/S | actually measured ΔV | actually measured charging efficiency |
|---|---|---|---|---|---|
| flat (conventional) | 200 V | −45 μC/g | 0.6 mg/cm$^2$ | 140 V | 70% |
| irregularity (the invention) | 250 V | −45 μC/g | 0.6 mg/cm$^2$ | 225 V | 90% |

In case of development on the latent image having the irregularity structure, as shown in Table 12, the development contrast Vcont required for developing a same amount of toner increased to 250 V. This is presumably ascribable to a fact that the charging performance is improved whereby the development is terminated closer to the proper state. It was also found that, despite of a developed toner amount of same Q/S (=(Q/M)×(M/S)), the charging efficiency was drastically improved in comparison with the solid portion having the flat structure.

Figure 21:
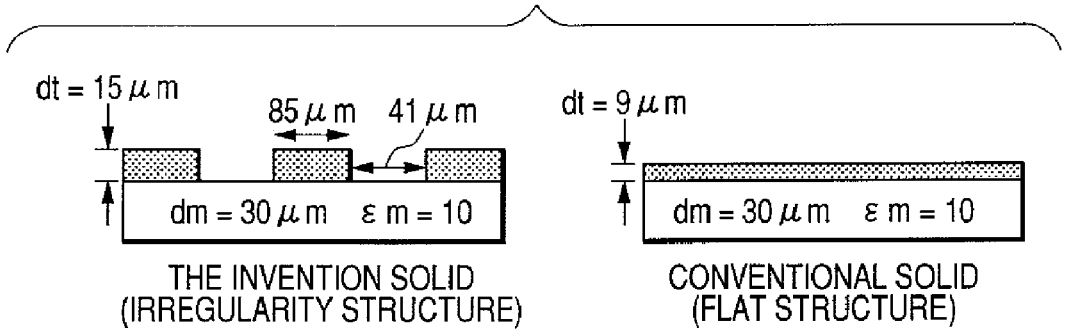
FIG. 21 is a view showing toner layers on the image bearing member at laser oscillation times of 80h and FFh.
Figure 22:
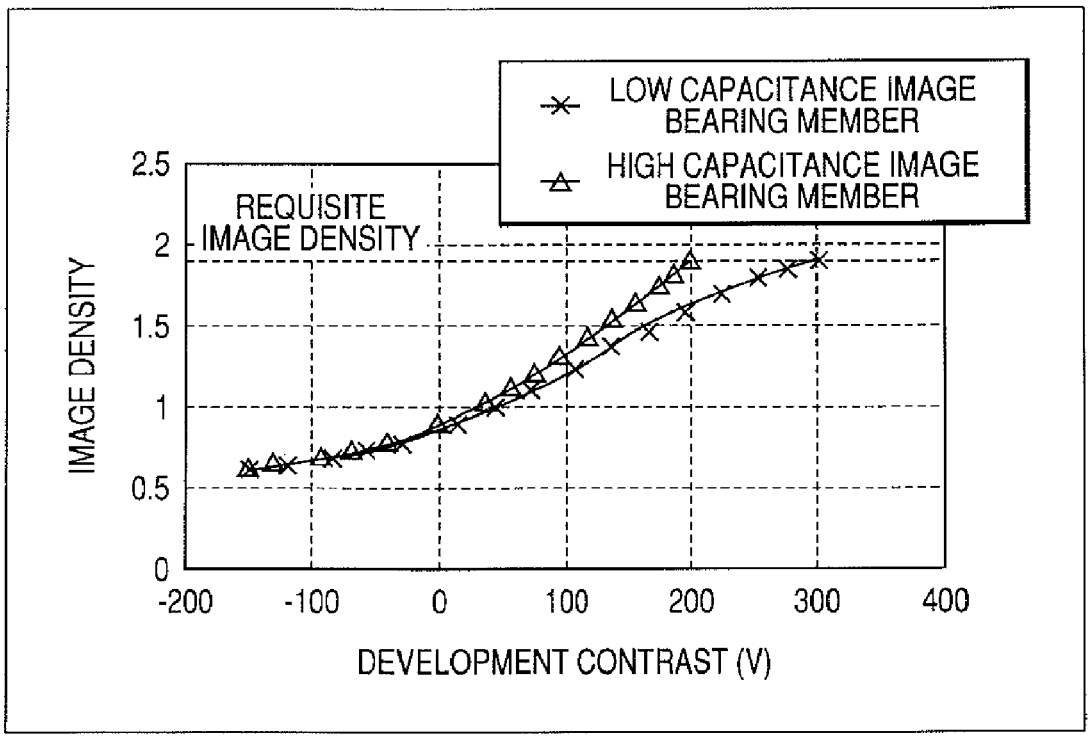
FIG. 22 is a view showing a V-D curve in an organic photoreceptor (low capacitance image bearing member) and in an α-Si photoreceptor (high capacitance image bearing member).

Then, in order to confirm the properness of the actually measured charge potential, a comparison was made between a theoretical value ΔVth of the charge potential and the actually measured charge potential ΔV. FIG. 21 shows results of observation of the toner layer by the aforementioned measuring method. It was confirmed that the toner layer on the image bearing member was completely interspaced (thinned), constituting an irregularity structure. In this case, the toner layer height dt was 15 μm as shown in FIG. 21.

TABLE 13

| toner image | Q/S | dt | actually measured ΔV | theoretical ΔV | blank area index | solid portion quality |
|---|---|---|---|---|---|---|
| flat | 2.7 × 10$^{-2}$ μC/cm$^2$ | 9 μm | 140 V | 146 V | 600 | ○ |
| irregularity | 2.7 × 10$^{-2}$ μC/cm$^2$ | 15 μm | 225 V | 183 V | 300 | ○ |

○: good

As shown in Table 13, the theoretical value of ΔV (183 V) is significantly different from the actually measured value (225 V). This is presumably ascribable to a fact that the toner layer of the irregularity structure is influenced by the air layer (relative permittivity: 1), and shows an increase in the charge potential corresponding to a decrease in the apparent permittivity of the toner layer. On the fixed image having a blank area, a blank area index was measured by the aforementioned measuring method. It was found that the blank area index was improved to an acceptable level of 300 by forming an irregularity structure in the solid portion. Then the quality of the solid portion after fixation was investigated by the aforementioned method. As a result, it was confirmed that the solid portion had a sufficiently acceptable quality.

Figure 24:
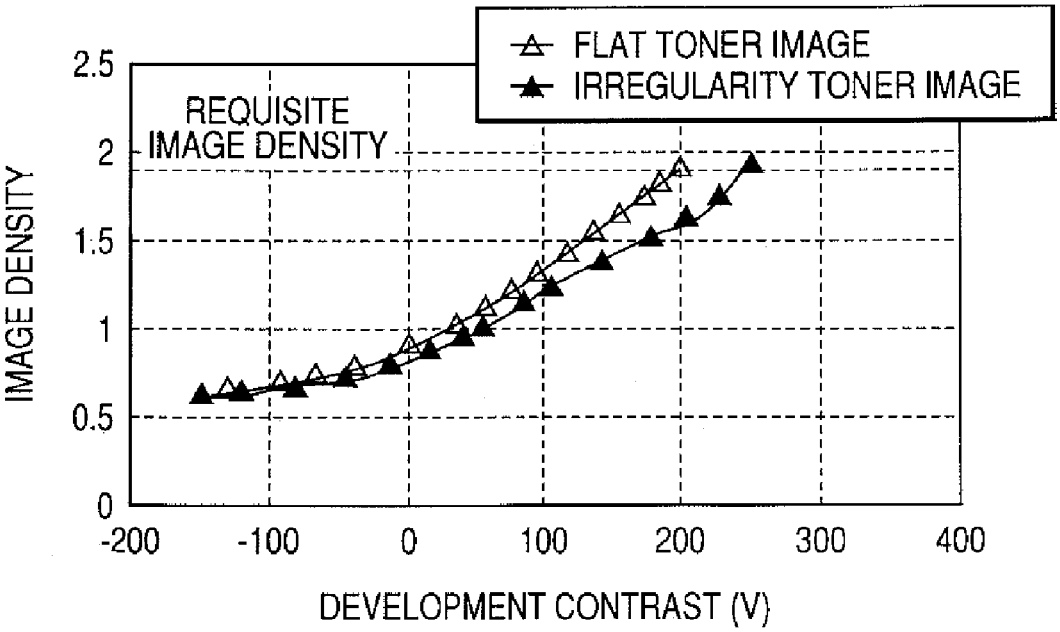
FIG. 24 is a view showing a V-D curve in an α-Si photoreceptor obtained in Embodiment 4, when a development contrast of 250 V is applied.

In case of forming an irregularity structure in the solid portion by pulse width modulation, a sufficient tone reproducibility can naturally be secured in the highlight portion and in the medium tone portion, by the pulse width modulation. FIG. 24 shows a V-D curve (image density as a function of development contrast at arbitrary 16 tone levels among 256 tone levels), in a pulse width modulation process of 80h for the solid portion, when the highlight portion and the medium tone portion are so pulse width modulated as to have a sufficient tone reproducibility. It was confirmed that, in comparison with a conventional system of low charging performance (flat toner image in solid portion), the V-D curve became flatter in the present embodiment (irregularity toner image in the solid portion) because of the improved charging performance. It is also possible to secure the tone reproducibility further, by combining the pulse width modulation and the dither method or the density pattern method in the binary recording method.

The present embodiment has shown an example by a pulse width modulation, but any means or any tone reproducing method may be employed without restriction as long as an irregularity structure is given to the toner image in the solid portion. Thus, in addition to the pulse width modulation, other multilevel recording methods such as intensity modulation are also included in the scope of the appended claims, as long as capable of generating an irregularity structure in the toner image in the solid portion.

In the present embodiment, an image forming mode in which the toner image in the solid portion is completely interspaced (thinned) or an image forming mode in which it is not completely interspaced (thinned) can be selected by mode selection means in the operation panel 10 (FIG. 8). In addition, in the case that the user gives an emphasis on the image quality (gloss) of the solid portion, an image forming mode for forming an ordinary flat toner image can be arbitrarily selected. The control circuit 9 executes an image forming mode selected and designated in the operation panel 10. The control circuit 9 may be so constructed as to control the laser scanner 3. Also there is provided a mode of automatically detecting a portion where an image defect such as a blank area is easily noticeable and a portion where it is less noticeable, and automatically setting an ordinary flat latent image in a portion where the image defect is not easily noticeable such as a character image.

As explained above, an irregularity structure is given to the toner image in the solid portion, thereby forming the toner image in the solid portion higher and reducing the permittivity of the toner layer by an effect of an air layer. It is thus rendered possible to drastically improve the "deficient charging", constituting a detriment in using an image bearing member of a high capacitance, and to output an image excellent in the tone reproducibility.

The foregoing embodiments have been explained in a case of utilizing a two-component developer constituted of a toner and a carrier, but the present invention is also applicable to a one-component developer constituted of toner. In the developing process utilizing a one-component developer, a developer carrying member, carrying the toner, is contacted with an image bearing member or is opposed, in a non-contact proximity, thereto and a development bias is applied to the developer carrying member, whereby an electrostatic latent image formed on the image bearing member is developed with the toner. In this case, the toner may be a non-magnetic toner or a magnetic toner.

Figure 7A:
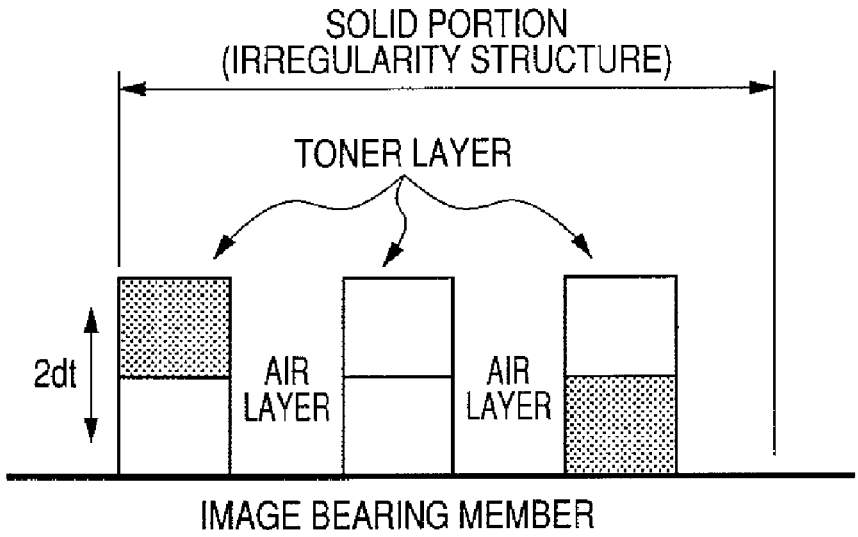
FIGS. 7A and 7B are conceptual views showing comparison of a toner image formation in a solid portion in the present invention and in a prior technology.
Figure 7B:
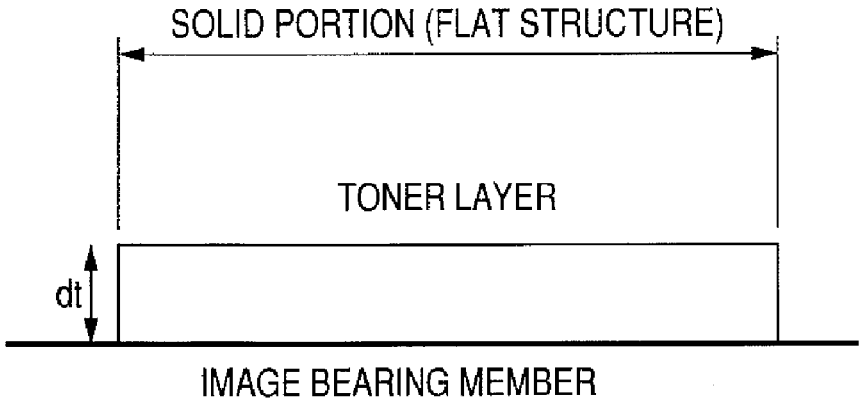

The present invention will be explained again, summarizing the foregoing description. FIGS. 7A and 7B are conceptual views comparing the modes of toner image formation in a solid portion, in the present invention and in the conventional method, in which FIG. 7A shows the present invention, while FIG. 7B shows the conventional example. The present invention is characterized, as shown in FIG. 7A, in that the latent image in the solid portion is so formed as to be toner developed with an irregularity structure. In this operation, in order to secure an image density after fixation of a same level as the density in the conventional structure (flat structure) in the solid portion, the toner amount on the image bearing member after development is required to be about the same as in the conventional method. By forming, in the solid portion, an irregularity structure in the toner layer on the image bearing member, the toner layer becomes higher (dt→2dt) in comparison with the conventional flat structure as shown in FIG. 7B, for a same developed toner amount. Also the apparent permittivity of the toner layer can be reduced by the influence of an air layer, formed by the irregularity structure in addition to the toner layer. Therefore, in the first term of equation 1, it is possible to increase dt (toner layer height) and to decrease $\epsilon_t$ (relative permittivity of toner), thereby causing an apparent increase in the potential ΔVt formed by the toner layer. It is thus possible to improve the deficient charging, thereby improving the image defect (blank area) caused by the deficient charging and also enabling an image output with an excellent tone reproducibility.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priorities from Japanese Patent Application Nos. 2005-274049 filed Sep. 21, 2005 and 2006-246631 filed Sep. 12, 2006, which are hereby incorporated by reference herein.

What is claimed is:

1. An image forming apparatus comprising:

a photosensitive member, having a capacitance per unit area of $1.7\times10^{-6}$ (F/m$^2$) or larger;

an exposure device, which exposes the photosensitive member to form an electrostatic image according to image information on the photosensitive member;

a developing device, which develops the electrostatic image with a toner to form a toner image on the photosensitive member;

a transfer device, which transfers the toner image onto a recording material; and an execution portion, which executes at least a mode of forming electrostatic images different in potential level on an image area of the photosensitive member on which an image corresponding to a maximum image density is to be formed, so that a toner bearing amount per unit area becomes a toner bearing amount corresponding to the maximum image density, when the image corresponding to the maximum image density is formed on the recording material.

2. An image forming apparatus according to claim 1, wherein the following relationship is satisfied:

$$(\Delta V/\mathrm{Vcont})\times100\geqq90(\%),$$

where a development contrast Vcont (V) indicates a potential difference between a DC component of a development bias and a potential for forming the toner image in the image area at the maximum image density, and ΔV(V) indicates a potential difference between the potential formed on the photosensitive member for forming the toner image in the image area at the maximum image density before a development by the developing device and a potential formed on the photosensitive member for forming the toner image in the image area at the maximum image density after development of the toner image by the developing device.

3. An image forming apparatus according to claim 1, wherein the photosensitive member includes a photoconductive layer containing amorphous silicon.

4. An image forming apparatus according to claim 1, wherein the image forming apparatus is operable in a first mode and a second mode, wherein the first mode is a mode in which the toner image in the image area at the maximum image density is formed by electrostatic images of different potential levels, wherein the second mode is a mode in which the toner image in the image area at the maximum image density is formed by electrostatic images of the same potential level, wherein the image forming apparatus further comprises selecting means for selecting between the first mode and the second mode, and wherein the control portion controls the potential of the photosensitive member so that the first mode and the second mode are selectively executed in accordance with a selection of the selecting means.

* * * * *